US006347514B1

(12) United States Patent
Takahashi et al.

(10) Patent No.: US 6,347,514 B1
(45) Date of Patent: Feb. 19, 2002

(54) AIR-FUEL RATIO CONTROL SYSTEM FOR ENGINE

(75) Inventors: Hideaki Takahashi; Kimiyoshi Nishizawa, both of Yokohama (JP)

(73) Assignee: Nissan Motor Co., Ltd., Yokohama (JP)

( * ) Notice: Subject to any disclaimer, the term of this patent is extended or adjusted under 35 U.S.C. 154(b) by 0 days.

(21) Appl. No.: 09/586,614

(22) Filed: Jun. 2, 2000

(30) Foreign Application Priority Data

Jun. 4, 1999 (JP) ..... 11-157598

(51) Int. Cl.[7] ..... F01N 3/00
(52) U.S. Cl. ..... 60/285; 60/274; 123/692
(58) Field of Search ..... 60/274, 285, 288; 123/691, 692

(56) References Cited

U.S. PATENT DOCUMENTS 5,074,113 A * 12/1991 Matsuoka ..... 60/285
5,207,057 A 5/1993 Kayanuma ..... 60/276
5,279,114 A * 1/1994 Kurita et al. ..... 123/691
5,341,788 A * 8/1994 Uchida ..... 123/692
5,377,484 A * 1/1995 Shimizu ..... 60/285
5,394,691 A * 3/1995 Seki ..... 60/285
5,417,058 A * 5/1995 Shimizu ..... 60/285
5,749,221 A * 5/1998 Kawahira et al. ..... 60/285

FOREIGN PATENT DOCUMENTS

JP 8-6624 1/1996

* cited by examiner

*Primary Examiner*—Thomas Denion
*Assistant Examiner*—Diem Tran
(74) *Attorney, Agent, or Firm*—Foley & Lardner

(57) ABSTRACT

In an engine having first and second cylinder groups, a first sensor senses an air-fuel ratio of an exhaust gas mixture into a first catalytic converter for the first cylinder group, a second sensor senses an air-fuel ratio of an exhaust gas mixture into a second catalytic converter for the second cylinder group. A controller normally controls the air fuel ratios of the first and second cylinder groups independently by using first and second air-fuel ratio feedback correction coefficients. When a diagnosis for the catalytic converters is required, the controller measures a rich time and a lean time in the air-fuel ratio variation of the second cylinder group in accordance with an output of the second sensor to determine a second cylinder group's rich/lean ratio between the rich time and the lean time, calculates a correction quantity to bring the second cylinder group's ratio closer to a target ratio, and determines a modified coefficient by modifying the first air-fuel ratio feedback correction coefficient with the correction quantity feedback-controls the air-fuel ratio of the second cylinder group with the modified coefficient as the second air-fuel ratio feedback correction coefficient.

20 Claims, 15 Drawing Sheets

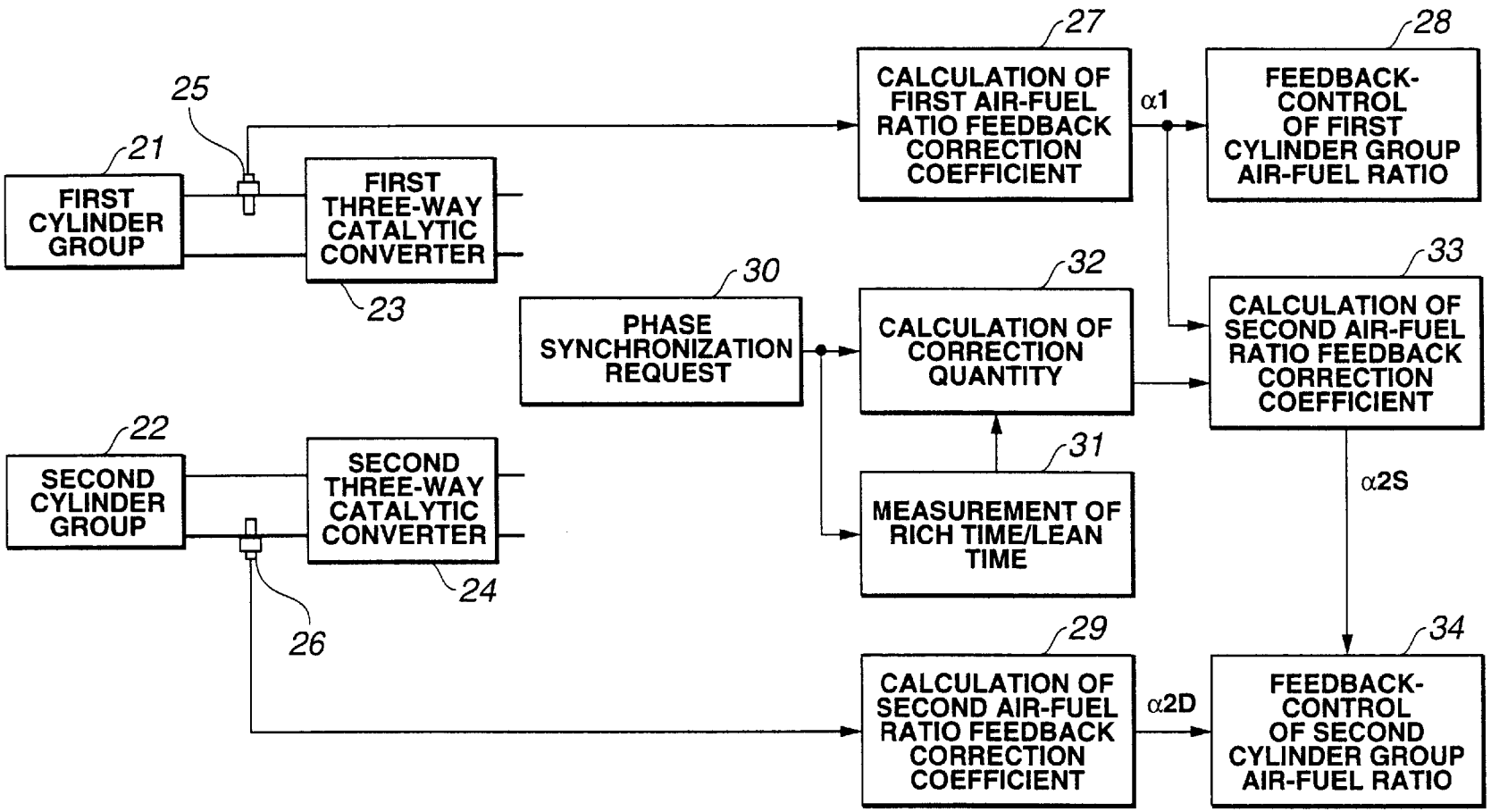
FIG.16
FIRST CYLINDER GROUP
21
25
FIRST THREE-WAY CATALYTIC CONVERTER
23
SECOND CYLINDER GROUP
22
26
SECOND THREE-WAY CATALYTIC CONVERTER
24
PHASE SYNCHRONIZATION REQUEST
30
CALCULATION OF FIRST AIR-FUEL RATIO FEEDBACK CORRECTION COEFFICIENT
27
CALCULATION OF CORRECTION QUANTITY
32
MEASUREMENT OF RICH TIME/LEAN TIME
31
CALCULATION OF SECOND AIR-FUEL RATIO FEEDBACK CORRECTION COEFFICIENT
29
FEEDBACK-CONTROL OF FIRST CYLINDER GROUP AIR-FUEL RATIO
28
CALCULATION OF SECOND AIR-FUEL RATIO FEEDBACK CORRECTION COEFFICIENT
33
FEEDBACK-CONTROL OF SECOND CYLINDER GROUP AIR-FUEL RATIO
34
α1
α2S
α2D

AIR-FUEL RATIO CONTROL SYSTEM FOR ENGINE

BACKGROUND OF THE INVENTION

The present invention relates to an air-fuel ratio control system for an engine.

When a three-way catalyst of a catalytic converter is not deteriorated, an output of a downstream $O_2$ sensor disposed on a downstream side of the catalytic converter has a long inversion period, due to an oxygen storage function of the three-way catalyst. When the three-way catalyst is deteriorated, however, the inversion period of the output of the downstream $O_2$ sensor becomes shorter (approaching an inversion period of an output of an upstream $O_2$ sensor disposed on an upstream side of the catalytic converter). Whether or not the three-way catalyst is deteriorated can be diagnosed in accordance with a ratio of the inversion period of the downstream $O_2$ sensor output to the inversion period of the upstream $O_2$ sensor output.

However, in the case of an engine having two cylinder groups provided with respective three-way catalytic converters in respective exhaust passages, and two upstream oxygen sensors for sensing the air fuel ratios on the upstream side of the catalytic converters to feedback-control the air fuel ratios of the two cylinder groups individually, the above-mentioned diagnosis of the three-way catalyst requires downstream $O_2$ sensors for the two catalytic converters to the disadvantage of cost. In a diagnostic system employing only one downstream $O_2$ sensor in a common exhaust passage into which the two exhaust passages from the two cylinder groups merge, the accurate diagnosis is possible only when the rich-lean air-fuel ratio variations of the two cylinder groups are in phase. If the rich-lean air-fuel ratio variations of the two cylinder groups are out of phase or in opposition, the rich side of one cylinder group and the lean side of the other cylinder group cancel each other, and hence the output waveform of the downstream $O_2$ in the common exhaust passage becomes flatter with little inversion, irrespective of deterioration or non-deterioration of the three-way catalyst.

Japanese-Patent Examined Publication No. 8(1996)-6624 describes an air-fuel ratio control system for controlling the air fuel ratios of two cylinder groups in accordance with an output of one of upstream $O_2$ sensors when diagnosis is required to detect deterioration of the three way-catalytic converters.

SUMMARY OF THE INVENTION

However, this conventional system might decrease the effect of exhaust gas purification by leaving one cylinder group uncontrolled during the diagnosis. The diagnosis is performed at the cost of the emission control performance.

In this case, a system called a double $O_2$ sensor system can control the air-fuel ratio in the common exhaust passage at the stoichiometric level with a downstream $O_2$ sensor whose output is used to modify the air-fuel ratio feedback correction coefficient based on the output of the upstream $O_2$ sensor. This system can ensure good exhaust emission purification by adding a third three-way catalytic converter. However, the control system cannot always hold both of the air-fuel ratios of the first and second cylinder groups at the stoichiometric ratio, so that it is difficult to maintain the efficiency of the three-way catalyst of each cylinder group at a satisfactory level. If, for example, the air-fuel ratio of the first cylinder group is controlled at the stoichiometric level by the feedback control based on the output of the oxygen sensor for the first cylinder group, but the air-fuel ratio of the second cylinder group is shifted to the rich side, then the air-fuel ratio in the common exhaust passage is on the rich side and the double oxygen sensor system acts to shift the air-fuel ratios of both cylinder group toward the lean side. As a result, the air-fuel ratio of the first cylinder group becomes slightly lean whereas the air-fuel ratio of the second cylinder group becomes slightly rich. The control continues until the air-fuel ratio in the common exhaust passage becomes equal to the stoichiometric air-fuel ratio. This is true of another situation in which the air-fuel ratio of the second cylinder group is shifted to the lean side.

Moreover, in this double $O_2$ sensor system, the speed of the correction based on the output of the downstream $O_2$ sensor is generally low. Therefore, it requires a considerable time to secure the exhaust gas mixture purifying efficiency with the three-way catalyst in the common exhaust passage. During this, the exhaust emission control can be poor.

It is an object of the present invention to provide air-fuel ratio control technique for synchronizing air-fuel ratio variations of two cylinder groups, and simultaneously without costing the exhaust emission control efficiency in both of two cylinder groups.

1) There is provided an air-fuel ratio control system for an engine according to the present invention. This air-fuel ratio control system comprises; a first cylinder group; a second cylinder group; a first catalytic converter disposed in a first exhaust passage from the first cylinder group; a second catalytic converter disposed in a second exhaust passage from the second cylinder group; a first air-fuel ratio sensor sensing an air-fuel ratio of an exhaust gas mixture flowing into the first catalytic converter; a second air-fuel ratio sensor sensing an air-fuel ratio of an exhaust gas mixture flowing into the second catalytic converter; and a controller calculating a first air-fuel ratio feedback correction coefficient in accordance with an output of the first air-fuel ratio sensor, feedback-controlling an air-fuel ratio of the first cylinder group by using the first air-fuel ratio feedback correction coefficient, determining whether a predetermined phase synchronization request is present for synchronizing air-fuel ratio variation of the first and second cylinder groups, measuring a rich time and a lean time in the air-fuel ratio variation of the second cylinder group in accordance with an output of the second air-fuel ratio sensor to determine a second cylinder group's ratio between the rich time and the lean time when the synchronism request is present, calculating a correction quantity to bring the second cylinder group's ratio closer to a target ratio when the synchronization request is present, determining a modified coefficient by modifying the first air-fuel ratio feedback correction coefficient with the correction quantity, and feedback-controlling the air-fuel ratio of the second cylinder group by using the modified coefficient as a second air-fuel ratio feedback correction coefficient when the in-phase request is present.

2) There is provided an air-fuel ratio control process for an engine according to the present invention. This air-fuel ratio control process comprises; ascertaining a sensed first air-fuel ratio of an exhaust gas mixture flowing into a first catalytic converter; ascertaining a sensed second air-fuel ratio of an exhaust gas mixture flowing into a second catalytic converter, calculating a first air-fuel ratio feedback correction coefficient in accordance with the sensed first air-fuel ratio, to feedback-control an actual air-fuel ratio of a first cylinder group by using the first air-fuel ratio feedback correction coefficient; determining whether a predetermined phase synchronization request is present for synchronizing air-fuel ratio variation of first and second cylinder groups;

measuring a rich time and a lean time in the air-fuel ratio variation of the second cylinder group in accordance with the sensed second air-fuel ratio to determine a second cylinder group's ratio between the rich time and the lean time when the synchronization request is present; calculating a correction quantity to bring the second cylinder group's ratio closer to a target ratio when the synchronization request is present; and determining a modified coefficient by modifying the first air-fuel ratio feedback correction coefficient with the correction quantity, to feedback-control the air-fuel ratio of the second cylinder group by using the modified coefficient as a second air-fuel ratio feedback correction coefficient when the synchronization request is present.

3) There is provided an air-fuel ratio control apparatus for an engine according to the present invention. This air-fuel ratio control apparatus comprises; means for calculating a first air-fuel ratio feedback correction coefficient in accordance with an output of a first air-fuel ratio sensor; means for feedback-controlling an air-fuel ratio of a first cylinder group by using the first air-fuel ratio feedback correction coefficient; means for determining whether a predetermined phase synchronization request is present for synchronizing air-fuel ratio variation of first and second cylinder groups; means for measuring a rich time and a lean time in the air-fuel ratio variation of the second cylinder group in accordance with an output of a second air-fuel ratio sensor to determine a second cylinder group's ratio between the rich time and the lean time when the synchronization request is present; means for calculating a correction quantity to bring the second cylinder group's ratio closer to a target ratio when the synchronization request is present; means for determining a modified coefficient by modifying the first air-fuel ratio feedback correction coefficient with the correction quantity; and means for feedback-controlling the air-fuel ratio of the second cylinder group by using the modified coefficient as a second air-fuel ratio feedback correction coefficient when the synchronization request is present.

BRIEF DESCRIPTION OF THE DRAWINGS

FIG. 16 is a block diagram showing a basic arrangement employed in the illustrated embodiment of the present invention.

DETAILED DESCRIPTION OF THE EMBODIMENT

Figure 1:
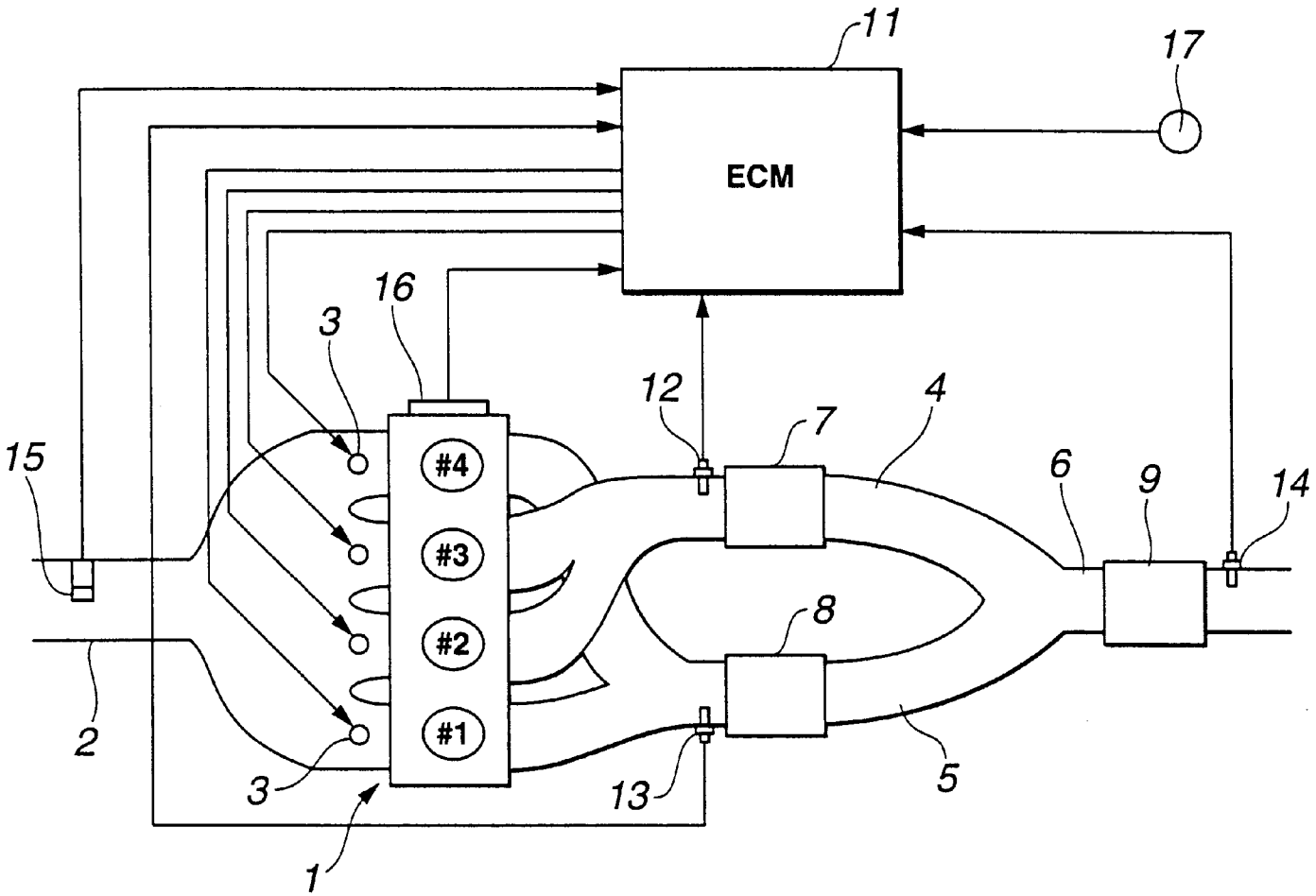
FIG. 1 is an air-fuel ratio control system for an engine, according to preferred embodiments of the present invention.

FIG. 1 shows a main body 1 of an in-line four-cylinder engine, and an air intake passage 2. Each of the four cylinders of the engine has a fuel injection valve 3. Each fuel injection valve 3 supplies an intake port with a pressurized fuel from a fuel supply system (not shown).

The engine main body 1 has two cylinder groups (or banks). In this example, the first cylinder group ("bank 1") includes cylinders No. 2 and No. 3, and the second cylinder group ("bank 2") includes cylinders No. 1 and No. 4. The first and second cylinder groups, respectively, have exhaust passages 4 and 5. The exhaust passages 4 and 5, respectively, have therein first and second three-way catalytic converters 7 and 8. The exhaust passage 4 and the exhaust passage 5 merge together into a common exhaust passage 6 having therein a third three-way catalytic converter 9.

At the stoichiometric air-fuel ratio, each of the first, second and third three-way catalytic converters 7, 8, and 9 reduces NOx and oxidizes HC and CO in an exhaust gas mixture at peak conversion efficiency. To achieve this, first and second $O_2$ sensors 12 and 13, respectively, provided on upstream sides of the first and second catalytic converters 7 and 8 supply outputs to an ECM (electronic control module) 11. Also supplied to the ECM 11 are an intake air-flow signal from an air-flow meter 15, a unit crank angle signal from a crank angle sensor 16, and a reference position signal discriminating the cylinders also from the crank angle sensor 16. The ECM 11 includes a microcomputer as a main component. The ECM 11 carries out a feedback-control of the bank 1 and the bank 2 separately in order that an air-fuel ratio of the exhaust gas mixture flowing into each of the first and second three-way catalytic converters 7 and 8 becomes equal to the stoichiometric air-fuel ratio.

In the following explanation on the individual air-fuel ratio control for the first and second cylinder groups, the first cylinder group is taken as an example. A base injection pulse width Tp (corresponding to a fuel quantity to achieve the stoichiometric air-fuel ratio) required for one combustion cycle (crank angle of 720°) for one cylinder is calculated from the engine speed Ne and an intake air quantity Qa. Moreover, a first air-fuel ratio feedback correction coefficient $\alpha 1$ is calculated in accordance with an output OSF1 of the first upstream $O_2$ sensor 12. The first air-fuel ratio feedback correction coefficient $\alpha 1$ is used to modify the base injection pulse width Tp, and to thereby calculate a fuel injection pulse width Ti1 of the first cylinder group. Then, each of the fuel injection valves 3 of the bank 1 is opened for a period determined by the fuel injection pulse width Ti1 at a predetermined injection timing.

When a catalyst in each of the first, second and third three-way catalytic converters 7, 8 and 9 is deteriorated, the conversion efficiency thereof becomes lower. Therefore, the EMC 11 diagnoses deterioration of each of the first, second and third three-way catalytic converters 7, 8 and 9, in accordance with the outputs of the downstream $O_2$ sensor 14 and the first or second upstream $O_2$ sensors 12 or 13. For the diagnosis, it is required to synchronize the phases of air-fuel ratio variations between the first and second cylinder groups.

The following flowcharts sequentially give full details of how the ECM 11 carries out the feedback-control of the bank 1 and the bank 2 separately.

FIG. 2 to FIG. 10 show a first preferred embodiment of the present invention.

Figure 2:
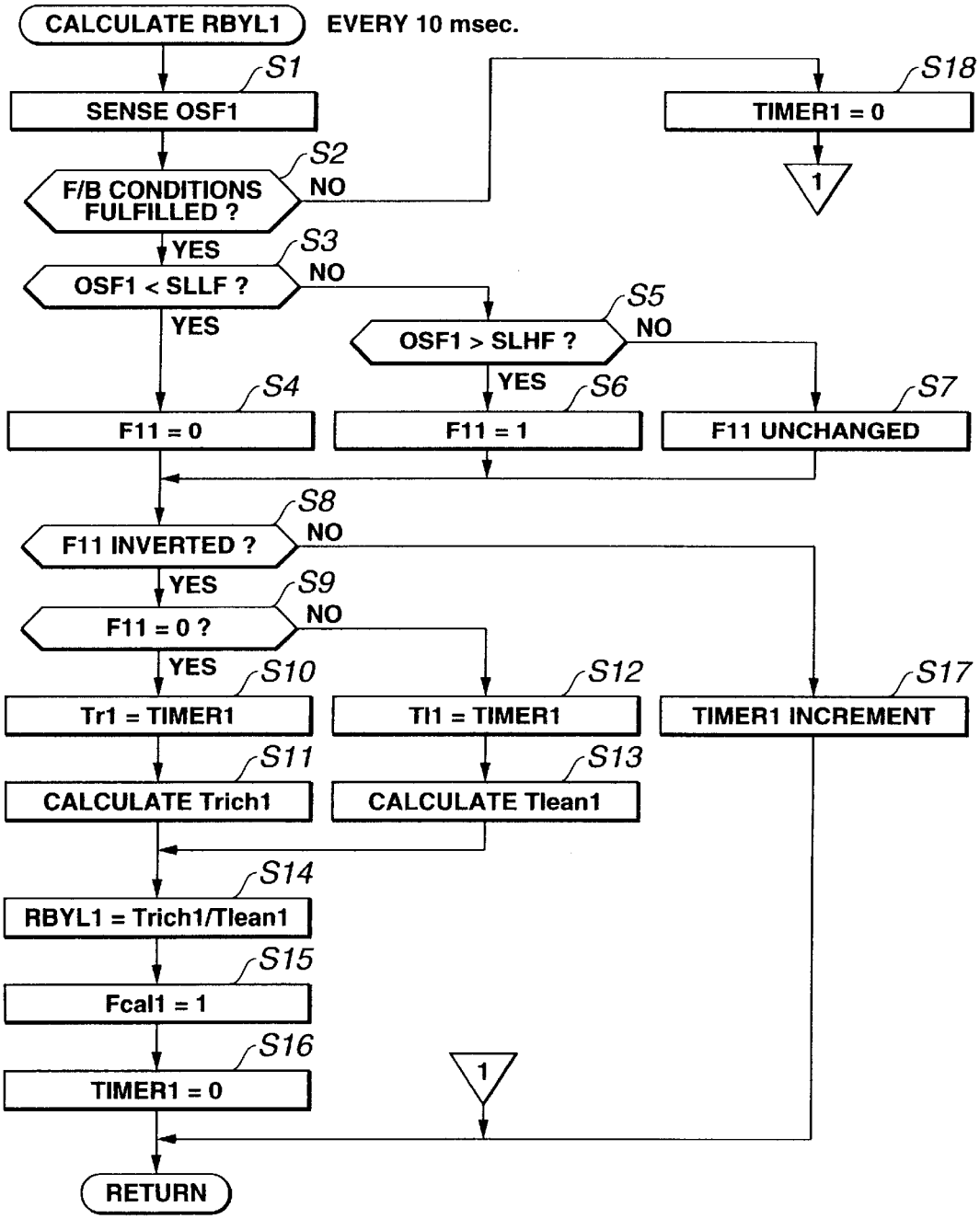
FIG. 2 is a flowchart for calculating a first rich/lean ratio RBYL1 of an air-fuel ratio variation of a bank 1, according to a first preferred embodiment of the present invention (FIG. 2 to FIG. 10).

A procedure shown in FIG. 2 is for calculating a first rich/lean time ratio RBYL1 of the air-fuel ratio variation of the first cylinder group. The calculation is carried out periodically at regular intervals (for example, every 10 msec.).

At step 1, the output OSFI of the first upstream $O_2$ sensor 12 of the bank 1 is read through an analog-digital (A/D) conversion.

At step 2, it is determined whether or not an air-fuel ratio feedback (F/B) condition is fulfilled. The feedback condition is satisfied when both of the following conditions are satisfied: 1. The activation of both the first and second upstream sensors 12 and 13 is completed. 2. A fuel increase correction coefficient COEF is equal to 1(Fuel enrichment just after engine start is completed).

If either or both of the above-mentioned two conditions is not fulfilled, a routine proceeds to step 18. A TIMER1 is reset at its initial value 0, to thereby terminate the present operation cycle. The TIMER1 is used for measuring a time during which the air-fuel ratio, when the feedback conditions are fulfilled, remains on the rich or lean side with respect to the stoichiometric air-fuel ratio.

When both the conditions are fulfilled, the routine proceeds from step 2 to step 3 and the subsequent steps to calculate the first rich-lean ratio RBYL1 of the first cylinder group. In this example, the first rich-lean ratio RBYLL of the bank 1 is required only in a situation requiring phase synchronization between the air-fuel ratio variations of the first and second cylinder groups (hereinafter referred to as "when a phase synchronization request is present"). Therefore, the check at step 2 of the feedback condition can be replaced by determination as to whether the phase synchronization request is present or absent.

Figure 9:
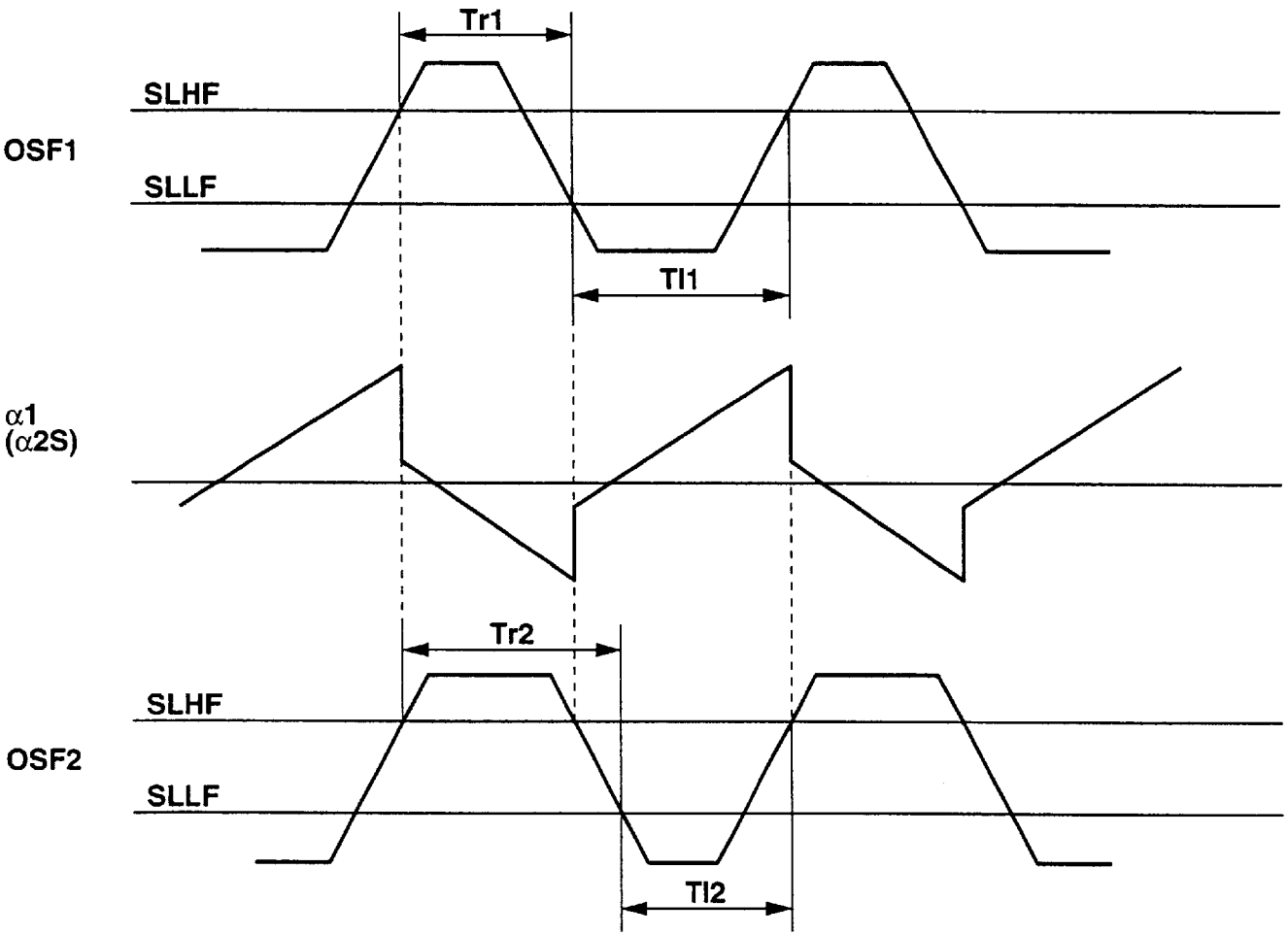
FIG. 9 is a modeled waveform of an output of an $O_2$ sensor on an upstream side of a catalytic converter immediately after the phase synchronization control is started.

At steps 3 to 7, the output OSF1 of the first upstream $O_2$ sensor 12 of the bank 1 is compared with a lean side slice level SLLF and a rich side slice level SLHF. The rich side slice level SLHF is greater than the lean side slice level SLLF (SLHF>SLLF) as shown in FIG. 9. In accordance with the result of the comparison, it is determined whether the air-fuel ratio of the exhaust gas mixture flowing into the first three-way catalytic converter 7 of the first cylinder group is on the rich side or lean side with respect to the stoichiometric air-fuel ratio. Then, a flag F11 is set. The flat F11 denotes that the air-fuel ratio is on the lean side with respect to the stoichiometric air-fuel ratio when F11=0, and denotes that the air-fuel ratio is on the rich side when F11=1.

At step 8, it is determined whether or not the flag F11 is inverted (from "0" to "1," or from "1" to "0").

When the flag F11 is not inverted, the routine proceeds to step 17 for an increment of the TIMER1. The TIMER1 is used to measure a duration during which the air-fuel ratio remains on the rich or lean side.

Only when the flag F11 is inverted, the routine proceeds to step 9. If F11=0, the routine transfers a value of the TIMER1 to a rich time Tr1 at step 10 (Tr1=TIMER1). It is immediately after the flag F11 is inverted from "1" to "0" that the routine proceeds to step 10 (in other words, immediately after the air-fuel ratio is inverted from rich to lean). The then-existing value of TIMER1 denotes a duration of the air-fuel ratio on the rich side.

Contrary to this, it is immediately after the flag F11 is inverted from "0" to "1" that the routine proceeds to step 12 (in other words, immediately after the air-fuel ratio is inverted from lean to rich). The TIMER1 at this point denotes a duration of the air-fuel ratio on the lean side. Therefore, the value of the TIMER1 is set as a lean time Tl1 at step 12 (Tl1=TIMER1).

At step 11 following step S10, a weighted mean Trich1 of the rich time Tr1 is calculated as follows:

$$Trich1 = kr \times Trich1z + (1-kr) \times Tr1 \quad \text{[Math 1]}$$

in which kr is a weighting factor ($0 \leqq kr < 1$), and Trich1$z$ is a previous value of Trich1.

Likewise, at step 13, a weighted mean Tlean1 of the lean time Tl1 is calculated as follows:

$$Tlean1 = kl \times Tlean1z + (1-kl) \times Tl1 \quad \text{[Math 2]}$$

in which kl is a weighting factor ($0 \leqq kl < 1$), and Tlean1$z$ is a previous value of Tlean1.

The lowercase suffix "z" hereinabove denotes a value calculated in the previous operation cycle. The suffix "z" is used for any other symbols hereinafter.

Dividing at step 14 the thus calculated weighted mean Trich1 of the rich time by the thus calculated weighted mean Tlean1 of the lean time makes a first rich/lean ratio RBYL1 of the first cylinder group:

$$RBYL1 = Trich1 / Tlean1 \quad \text{[Math 3]}$$

Namely, the first rich/lean ratio RBYL1 of the bank 1 is calculated every time any one of the rich time and the lean time is measured. However, the first rich/lean ratio RBYL1 of the bank 1 is not calculated at a timing when the flag F11 is inverted for the first time after the air-fuel ratio feedback conditions are fulfilled because at this timing, it is only one of the Trich1 and the Tlean1 that has been calculated. Adopting weighted means Trich1 and Tlean1 is for the purpose of stabilizing the rich time and the lean time.

At step 15, the routine makes a flag Fcal1=1. This flag Fcal1 denotes that the first rich/lean ratio RBYL1 of the air-fuel ratio variation of the bank 1 is calculated. Then at step 16, the TIMER1 is reset to 0 for calculating the next rich time and lean time.

Figure 4:
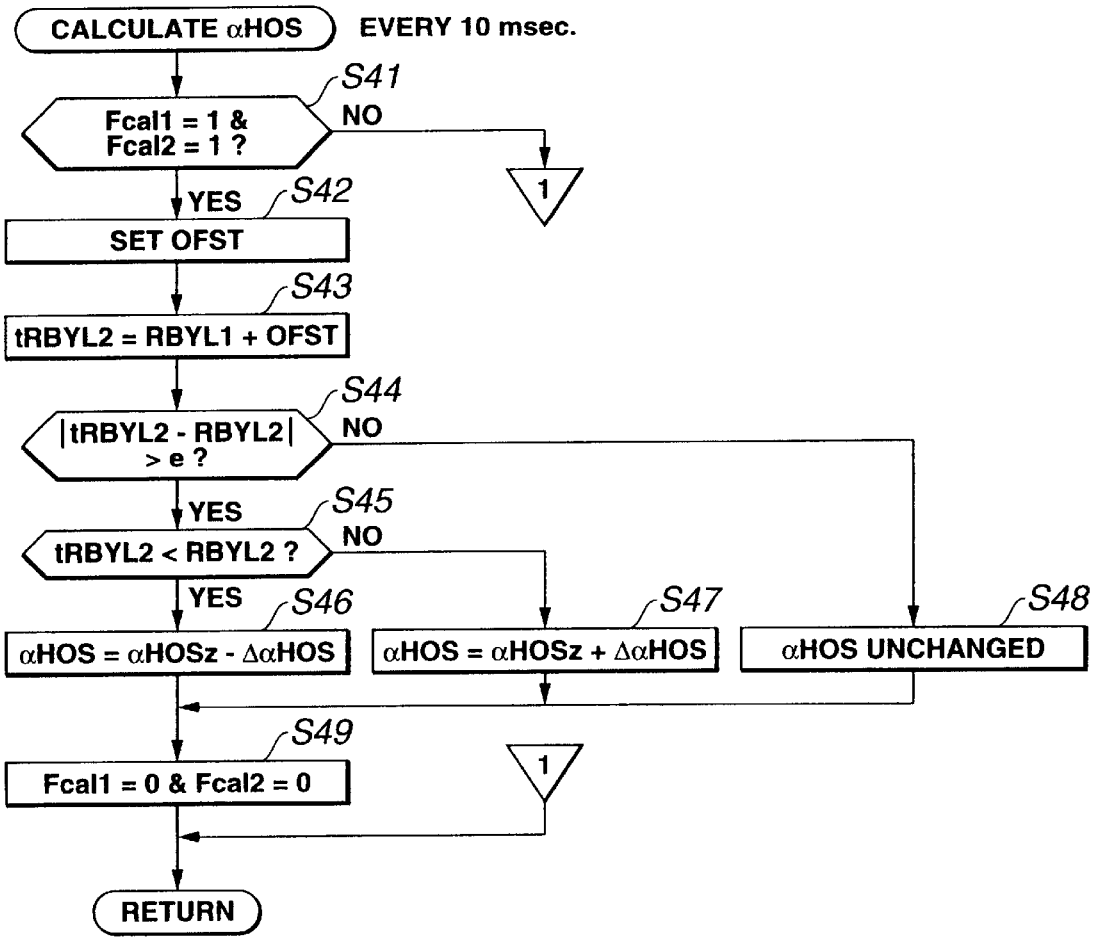
FIG. 4 is a flowchart for calculating a correction quantity αHOS.

The thus calculated first rich/lean ratio RBYL1 of the air-fuel ratio variation of the bank 1 is stored in a memory in the ECM 11. In FIG. 4 (aftermentioned), the routine reads out the first rich/lean ratio RBYL1 for calculating a correction quantity αHOS.

Figure 3:
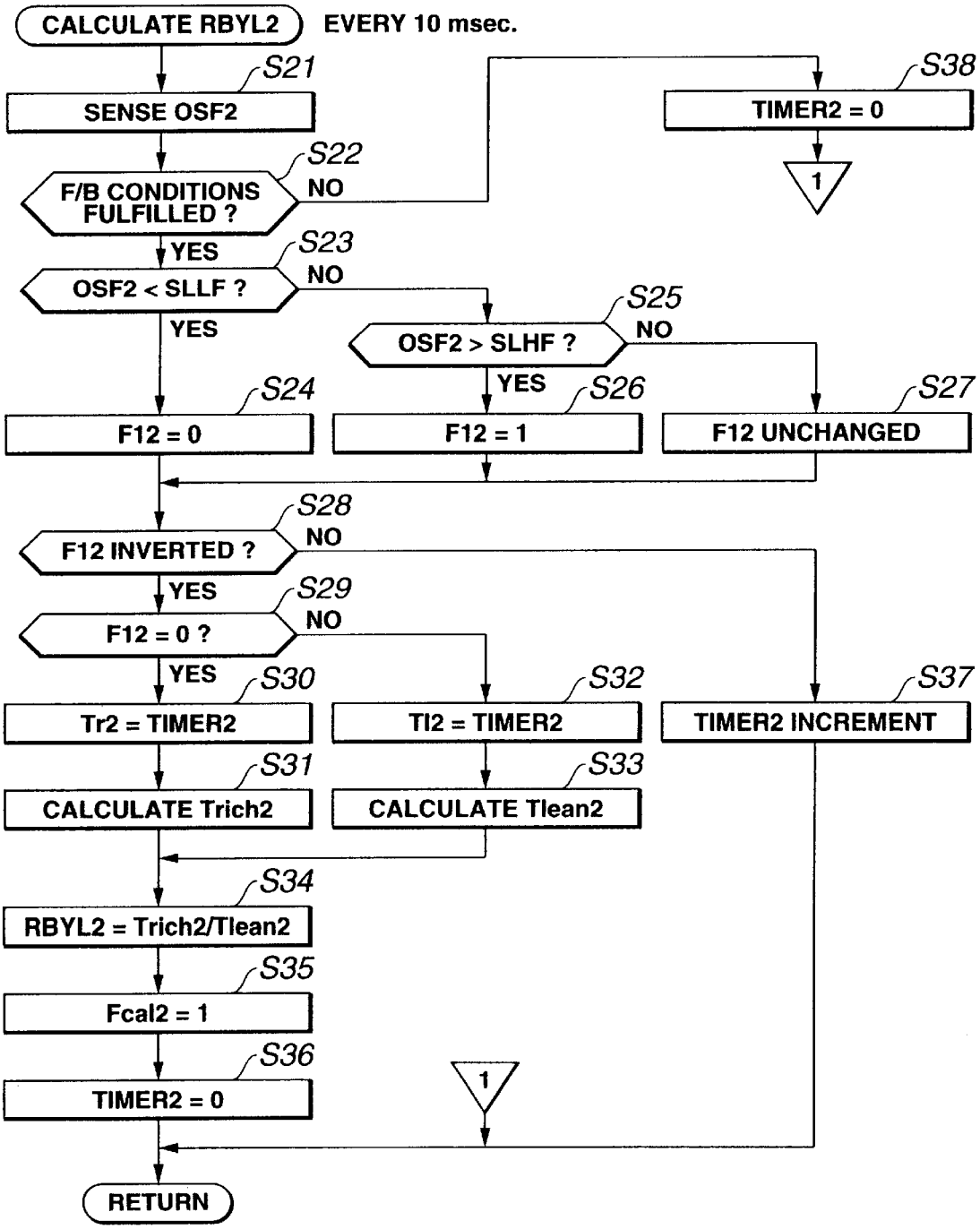
FIG. 3 is a flowchart for calculating a second rich/lean ratio RBYL2 of an air-fuel ratio variation of a bank 2.

FIG. 3 shows a calculation of a second rich/lean ratio RBYL2 of an air-fuel ratio variation of the bank 2. The second rich/lean ratio RBYL2 is calculated at a predetermined interval (for example, every 10 msec.), separately from the calculation of the first rich/lean ratio RBYL1 in FIG. 2. Detailed description of the calculation of the second rich/lean ratio RBYL2 is skipped since the calculation of the second rich/lean ratio RBYL2 in FIG. 3 is substantially the same as the calculation of the first rich/lean ratio RBYL1 in FIG. 2.

FIG. 4 shows a calculation of the correction quantity αHOS, and is carried out every 10 msec.

At step 41, two flags Fcal1 and Fcal2 are checked. The routine proceeds to step 42 only when both Fcal1=1 and Fcal2=1 (both the first rich/lean ratio RBYL1 of the air-fuel ratio variation of the bank 1 and the second rich/lean ratio RBYL2 of the air-fuel ratio variation of the bank 2 are calculated). At step 42, the routine sets up an offset quantity OFST. At step 43, the routine calculates a target rich/lean ratio tRBYL2 of the bank 2 by addition of the offset OSFT to the first rich/lean ratio RBYL1. Thus, the target rich/lean ratio tRBYL2 is set equal to RBYL1+OFST.

When the offset quantity OFST is positive, the target rich/lean ratio tRBYL2 of the bank 2 becomes greater than the first rich/lean ratio RBYL1 of the bank 1. On the contrary, when the offset quantity OFST is negative, the target rich/lean ratio tRBYL2 of the bank 2 becomes smaller than the first rich/lean ratio RBYL1 of the bank 1. When the offset quantity OFST=0, the target rich/lean ratio tRBYL2 of the bank 2 becomes equal to the first rich/lean ratio RBYL1 of the bank 1.

When the bank 1 and the bank 2 are separately controlled with the respective air-fuel ratio feedback-controls to the stoichiometric ratio, the first rich/lean ratio RBYL1 of the bank 1 becomes nearly the same as the second rich/lean ratio RBYL2 of the bank 2. However, the first rich lean ratio RBYL1 of the bank 1 is not exactly equal to the second rich/lean ratio RBYL2 of the bank 2. Therefore, if the second rich/lean ratio RBYL2 of the bank 2 is made equal to the first rich/lean ratio RBYL1 of the bank 1, the air-fuel ratio of the bank 2 is slightly different from the stoichiometric air-fuel ratio. The offset quantity OFST compensates for this difference. If the difference of the second rich/lean ratio RBYL2 of the bank 2 from the first rich/lean ratio RBYL1 of the bank 1 is known in advance, it is preferred to set in advance such an offset quantity OFST as to compensate for the known difference. For example, by storing the difference in a ROM in the ECM 11 as a single fixed value, or by storing the difference in a map (function) of the engine speed and the engine load. In case the difference of the second rich/lean ratio RBYL2 of the bank 2 from the first rich/lean ratio RBYL1 of the bank 1 is not known in advance, it is possible to employ the following method for determining the offset quantity OFST: When the phase synchronization request is absent and the air fuel ratio of the second cylinder group is feedback-controlled independently, the controller learns and stores values of the difference of the second rich/lean ratio RBYL2 of the bank 2 from the first rich/lean ratio RBYL1 of the bank 1 corresponding to the engine speed and the engine load. The thus stored learned value is used as offset quantity OFST. In case the deviation of the second rich/lean ratio RBYL2 of the bank 2 from the first rich/lean ratio RBYL1 of the bank 1 is minor (ignorable), it is not necessary to introduce the offset quantity OFST.

At step 44, the routine compares an absolute value of a deviation of the (actual) second rich/lean ratio RBYL2 of the bank 2 from the target rich/lean ratio tRBYL2 of the bank 2, with a predetermined value "e." When the absolute value of the deviation |tRBYL2−RBYL2| is equal to or smaller than the predetermined value "e," the routine proceeds to step 48 and holds the correction quantity αHOS unchanged without renewing the correction quantity αHOS to stabilize the control.

When the absolute value of the deviation |tRBYL2−RBYL2| exceeds the predetermined value "e," the routine proceeds to step 45 to compare the target rich/lean ratio tRBYL2 with the second rich/lean ratio RBYL2, and then renews the correction quantity αHOS so as to bring the second rich/lean ratio RBYL2 (actual) closer to the target rich/lean ratio tRBYL2. When tRBYL2<RBYL2, the air-fuel ratio of the bank 2 is shifted to the rich side. Therefore, in order to correct the air-fuel ratio of the bank 2 to the lean side, the routine decreases the correction quantity αHOS by a constant quantity ΔαHOS. Contrary to this, when tRBYL2≧RBYL2, the air-fuel ratio of the bank 2 is shifted to the lean side. Therefore, in order to correct the air-fuel ratio of the bank 2 to the rich side, the routine increases the correction quantity αHOS by the constant quantity ΔαHOS.

At step 49, the routine makes the flag Fcal1=0 and the flag Fcal2=0, to thereby prepare for calculating the next αHOS.

Figure 7:
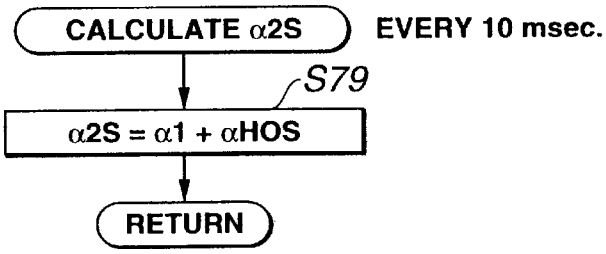
FIG. 7 is a flowchart for calculating a modified air-fuel ratio feedback correction coefficient α2S of the bank 2 when a phase synchronization request is present.

The thus-calculated correction quantity αHOS is stored in the memory in the ECM 11. In FIG. 7 (aftermentioned), the routine reads out the correction quantity αHOS and uses it for calculating a modified air-fuel ratio feedback correction coefficient α2S of the bank 2 when the phase synchronization request is present.

Figure 5:
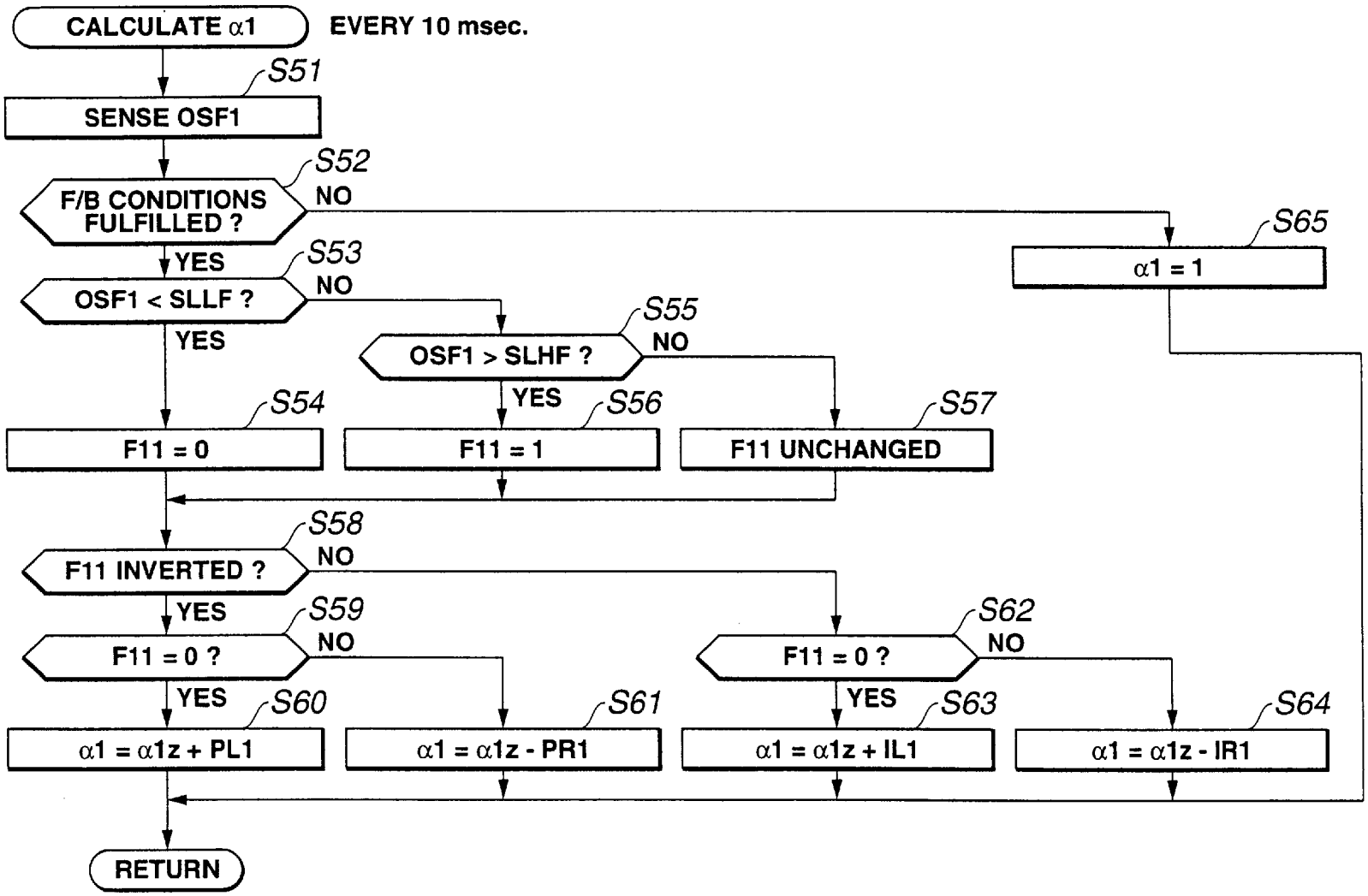
FIG. 5 is a flowchart for calculating a first air-fuel ratio feedback correction coefficient α1 of the bank 1.

FIG. 5 is a routine for calculating the first air-fuel ratio feedback correction coefficient α1 of the bank 1 in accordance with the output OSF1 of the first upstream $O_2$ sensor 12. The routine carries out the calculation at a predetermined interval (for example, every 10 msec.).

At step 51, the output OSF1 of the first upstream $O_2$ sensor 12 of the bank 1 is read through the analog-digital (A/D) conversion.

At step 52, like at step 2 in FIG. 2, it is determined whether or not the air-fuel ratio feedback (F/B) conditions are fulfilled. If the air-fuel ratio feedback conditions are fulfilled, the routine proceeds to steps 53 to 57 in order to compare the output OSF1 of the first upstream $O_2$ sensor 12 of the bank 1 with the lean side slice level SLLF and the rich side slice level SLHF. In accordance with the flag F11 denoting the thus obtained comparison results, the routine carries out, at steps 58 to 64, a pseudo-PI operation for calculating the first air-fuel ratio feedback correction coefficient α1 (see middle graph in FIG. 9) in a conventional manner.

On the other hand, if the air-fuel ratio feedback conditions are not fulfilled, the routine proceeds from step 52 to step 65 to makes α1=1 (clamp).

The thus calculated first air-fuel ratio feedback correction coefficient α1 is stored in the memory of the ECM 11. Then, the first air-fuel ratio feedback correction coefficient α1 is used in the calculation of the fuel injection pulse width Ti1 (not shown) of the bank 1. The calculation of the fuel injection pulse width Ti1 of the bank 1 for the fuel injection valves 3 of the bank 1 is expressed as:

$$Ti1=Tp\times COEF\times\alpha1+Ts \quad \text{[Math 4]}$$

in which,

Ti1: fuel injection pulse width of bank 1

Tp: base injection pulse width

COEF: fuel increase correction coefficient

α1: first air-fuel ratio feedback correction coefficient of bank 1

Ts: unavailable pulse width

Figure 6:
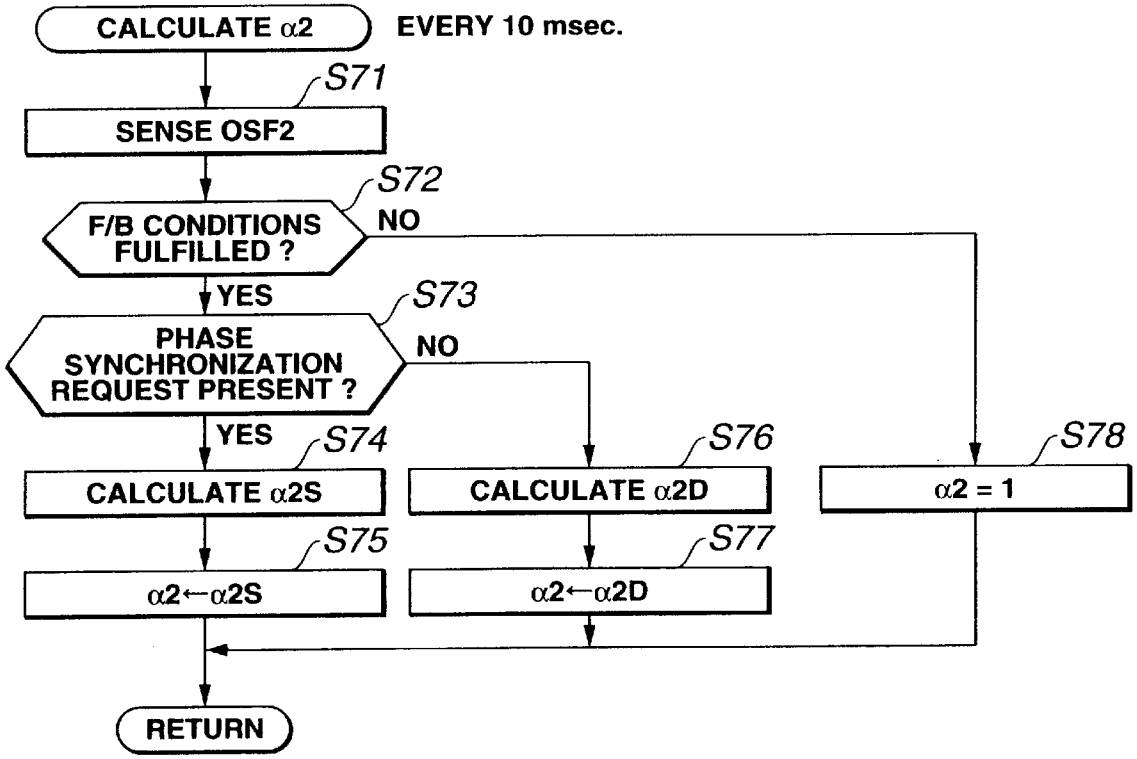
FIG. 6 is a flowchart for calculating a second air-fuel ratio feedback correction coefficient α2 of the bank 2.

FIG. 6 is a routine for calculating a second air-fuel ratio feedback correction coefficient α2 of the bank 2. The calculation is carried out at predetermined intervals (for example, every 10 msec.).

At step 71, an output OSF2 of the second upstream $O_2$ sensor 13 of the bank 2 is sensed through the analog-digital (A/D) conversion.

At step 72, like at step 22 in FIG. 3., it is determined whether or not the air-fuel ratio feedback (FIB) conditions are fulfilled. If the air-fuel ratio feedback conditions are not fulfilled, the routine proceeds to step 78 and makes α2=1 (clamp of α2), to thereby complete the present process.

If the air-fuel ratio feedback conditions are fulfilled, the routine proceeds to step 73 to determine whether or not the phase synchronization request is present. In other words, the routine determines that the phase synchronization request is present when conditions for diagnosing deterioration of the three-way catalyst are fulfilled. At step 74, the routine calculates the modified air-fuel ratio feedback correction coefficient α2S of the bank 2 when the phase synchronization request is present. As is seen in FIG. 7 (a sub-routine of step 74 in FIG. 6), the α2S is obtained with the first air-fuel ratio feedback correction coefficient α1 of the bank 1 added by the correction quantity αHOS (step 79). Then, at step 75 the routine inputs the thus calculated α2S to the second air-fuel ratio feedback correction coefficient α2 of the bank 2.

The correction quantity αHOS is positive or negative. When the correction quantity αHOS is positive, the second air-fuel ratio feedback correction coefficient α2 (α2S) of the bank 2 becomes larger than using only the first air-fuel ratio feedback correction coefficient α1 (as is) of the bank 1 (corrected toward rich side). Contrary to this, when the correction quantity αHOS is negative, the second air-fuel ratio feedback correction coefficient α2 (α2S) of the bank 2 becomes smaller than using only the first air-fuel ratio feedback correction coefficient α1 (as is) of the bank 1 (corrected toward lean side).

After calculating the α2S, it is preferred that the routine compares the α2S with upper and lower limits for limiting the α2S within the upper and lower limits. With this, an engine stall or the like can be prevented which may be caused when the control system is in failure.

On the other hand, the routine proceeds from step 73 to step 76 when the phase synchronization request is absent. The routine calculates an unmodified air-fuel ratio feedback correction coefficient α2D of the bank 2 when the phase synchronization request is absent. Then, at step 77 the routine inputs the thus calculated α2D to the second air-fuel ratio feedback correction coefficient α2 of the bank 2.

Figure 8:
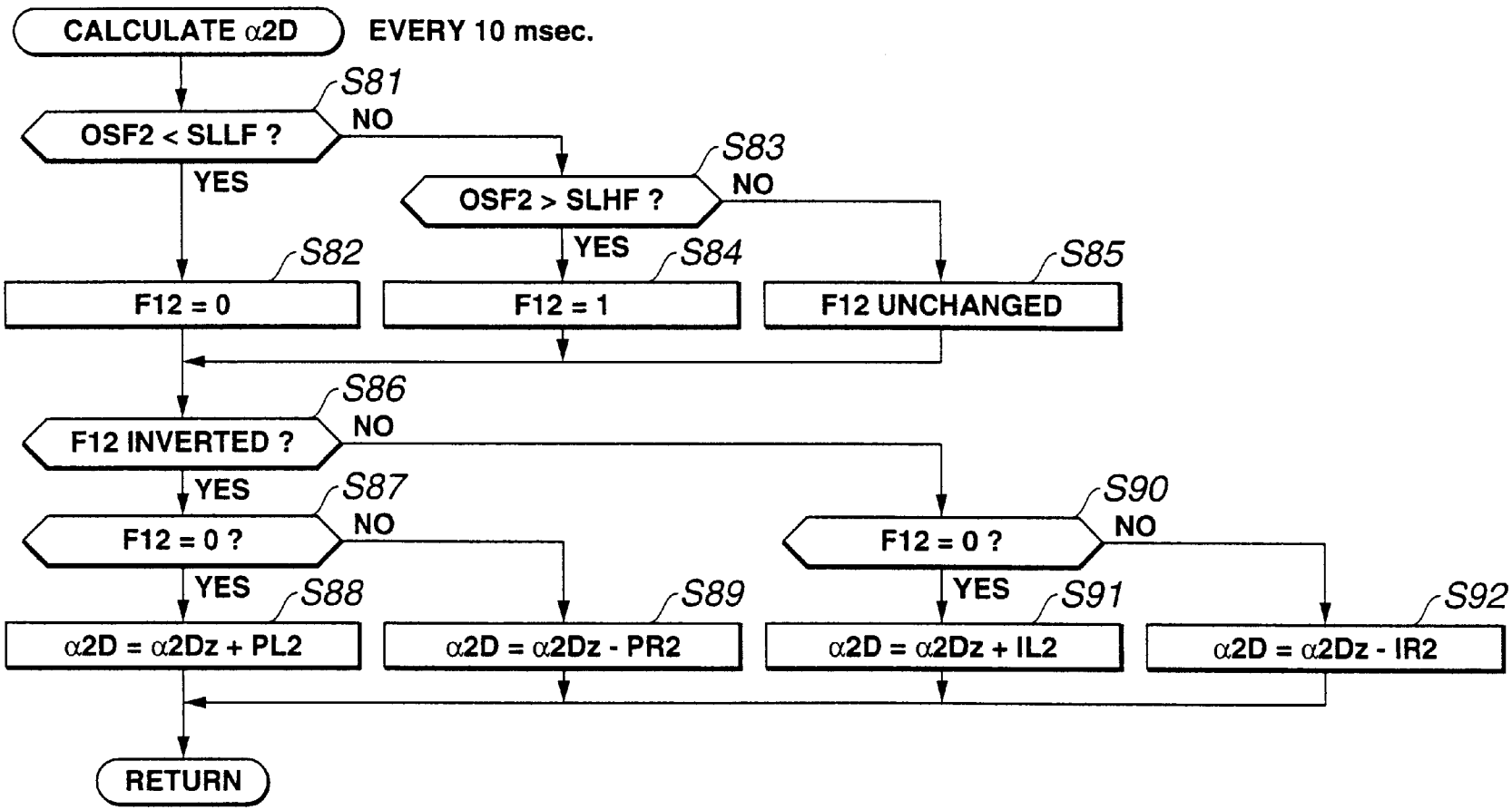
FIG. 8 is a flowchart for calculating an unmodified air-fuel ratio feedback correction coefficient α2D of the bank 2 when the phase synchronization request is absent.

FIG. 8 is a sub-routine of step 76 in FIG. 6 for calculating the unmodified air-fuel ratio feedback correction coefficient α2D of the bank 2 when the phase synchronization request is absent. The calculation of the α2D shown in FIG. 8 is like the calculation of the α1 shown in FIG. 5. Namely, steps 81 to 92 in FIG. 8 are like steps 53 to 64 in FIG. 5. The sub-routine carries out the pseudo-PI operation, in the traditional manner, for calculating the unmodified air-fuel ratio feedback correction coefficient α2D of the bank 2 when the phase synchronization request is absent.

The thus calculated second air-fuel ratio feedback correction coefficient α2 of the bank 2 is stored in the memory of the ECM 11. Then, the second air-fuel ratio feedback correction coefficient α2 of the bank 2 is used for calculating a fuel injection pulse width Ti2 of the bank 2. The fuel injection pulse width Ti2 of the bank 2 for the fuel injection valves 3 of the bank 2 is calculated as follows:

$$Ti2=Tp\times COEF\times\alpha 2+Ts \quad \text{[Math 5]}$$

in which,

Ti2: fuel injection pulse width of bank 2

Tp: base injection pulse width

COEF: fuel increase correction coefficient

α2: second air-fuel ratio feedback correction coefficient of bank 2

Ts: unavailable pulse width

Figure 10:
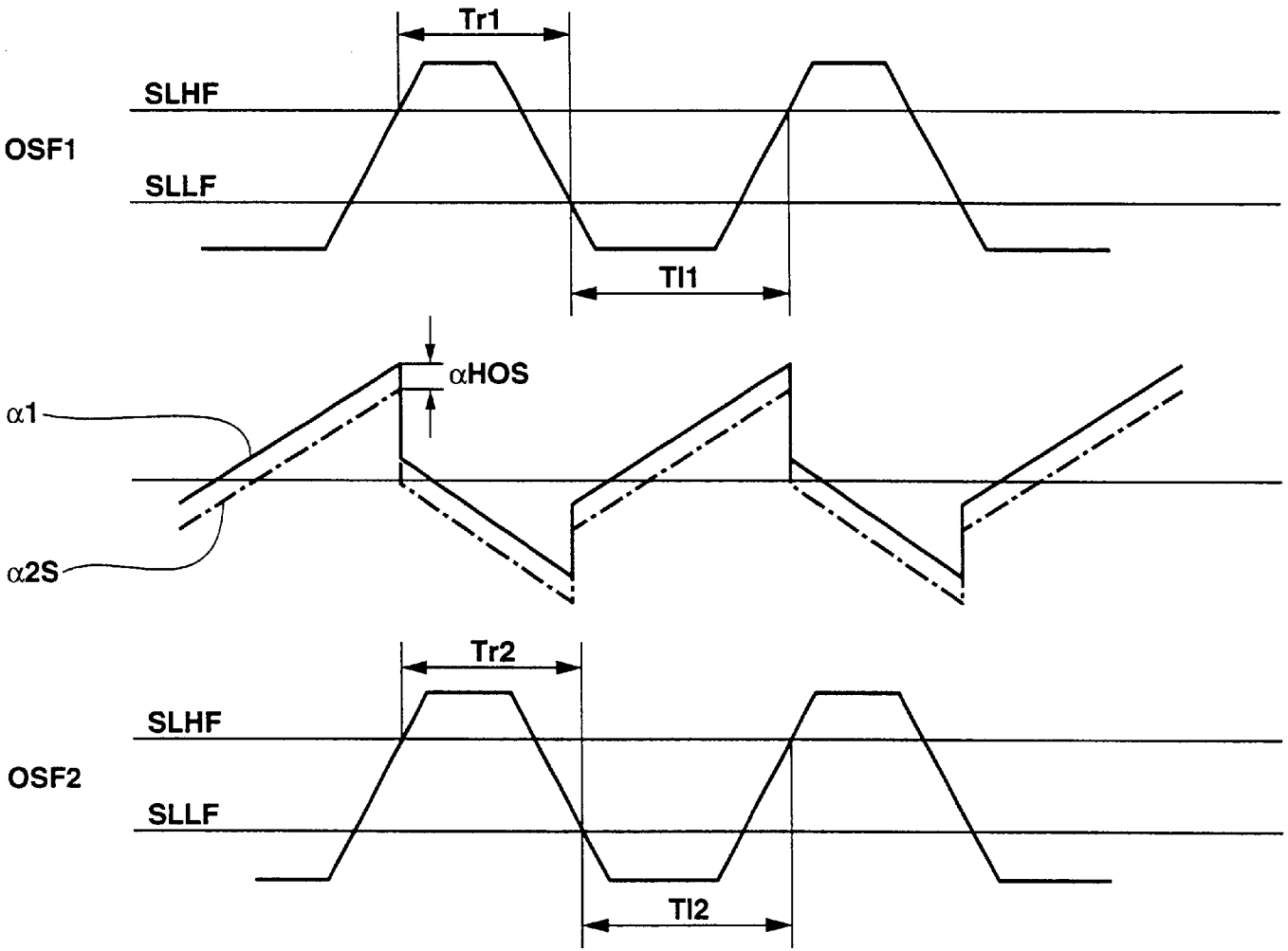
FIG. 10 is a modeled waveform of the output of the $O_2$ sensor on the upstream side of the catalytic converter after the phase synchronization control is completed.

FIG. 9 and FIG. 10 show operations of the first preferred embodiment of the present invention.

FIG. 9 shows, as a model, the output OSF1 of the first upstream $O_2$ sensor 12 of the bank 1 and the output OSF2 of the second upstream $O_2$ sensor 13 of the bank 2 immediately after the phase synchronization control is started. At the bank 1, the controller carries out the air-fuel ratio feedback-control in accordance with the output OSF1 of the first upstream $O_2$ sensor 12 of the bank 1, and the air-fuel ratio is controlled at the stoichiometric air-fuel ratio. Namely, in the cylinder group of the bank 1, the lean time Tl1 is slightly longer than the rich time Tr1 under the present operating conditions, with the air-fuel ratio controlled in the stoichiometric air-fuel ratio. On the other hand, the correction quantity αHOS is not calculated (αHOS=0) immediately after the phase synchronization control is started. Therefore, α2S=α1. Thus, contrary to the bank 1, the cylinder group of the bank 2 shows a rich time Tr2 that is slightly longer than a lean time Tl2. Namely, the air-fuel ratio of the bank 2 in FIG. 9 is shifted to the rich side with respect to the stoichiometric air-fuel ratio. Whether the air-fuel ratio of the bank 2, when α2S=α1, is shifted to the rich side or to the lean side depends on the engines and/or operating conditions. Therefore, FIG. 9 is only one example, not representing all types of outputs OSF1 and OSF2.

In the state of FIG. 9, tRBYL2 (=RBYL1+OSFT) <RBYL2. Therefore, the correction quantity αHOS is reduced by the ΔαHOS (negatively larger) stepwise. The α2S is smaller than the α1 by the αHOS. As a result of the control, α2S is varied as shown in the middle graph in FIG. 10. The second rich/lean ratio RBYL2 of the bank 2 becomes equal to the first rich/lean ratio RBYL1 of the bank 1 (except for a difference corresponding to the offset quantity OFST). Under the thus obtained condition, the air-fuel ratio of the bank 2 also substantially becomes the stoichiometric air-fuel ratio.

According to the first embodiment, the control system can control the air-fuel ratio of the bank 2 at the stoichiometric air-fuel ratio, with the phase of the air-fuel ratio variation of the bank 2 substantially coinciding with the phase of the air-fuel ratio variation of the bank 1.

In the conventional system using a first air-fuel ratio feedback correction coefficient α1 of the bank 1 with no modification as a second air-fuel ratio feedback correction coefficient α2 of the bank 2, the air-fuel ratio of the bank 2 is held on the rich or lean side with respect to the stoichiometric air-fuel ratio as shown in FIG. 9 always during the phase synchronization control, so that the catalytic converter 8 of the bank 2 can not operate effectively.

Figure 11:
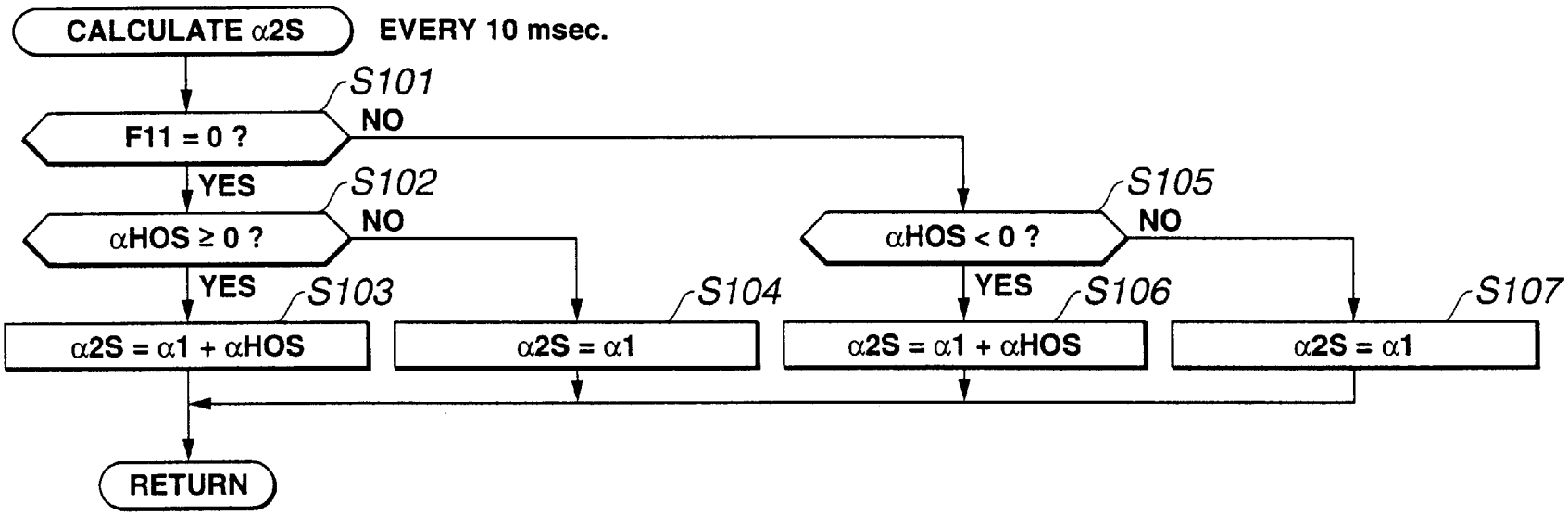
FIG. 11 is a flowchart for calculating the modified air-fuel ratio feedback correction coefficient α2S of the bank 2 when the phase synchronization request is present, according to a second preferred embodiment of the present invention.

FIG. 11 is a flowchart of a second preferred embodiment of the present invention. FIG. 11 corresponds to FIG. 7 of the first preferred embodiment of the present invention.

In the first preferred embodiment, the modified air-fuel ratio feedback correction coefficient α2S for the phase synchronization control is calculated by shifting the first air-fuel ratio feedback correction coefficient α1 of the bank 1 wholly to an increase side or a decrease side.

In the second preferred embodiment, the coefficient α1 of the bank 1 is shifted partly to the increase or decrease side to calculate the modified coefficient α2S of the bank 2.

For calculating the α2S shifted to the increase side (αHOS≧0), the routine proceeds from steps 101 and 102 to a step 103, and adds the correction quantity αHOS to the coefficient α1 at step 103 only when α1 is on the rich side (the output of the first upstream $O_2$ sensor 12 of the bank 1 is on the lean side). For calculating the α2S shifted to the decrease side (αHOS<0), the routine proceeds from the steps 10 and 105 to a step 106 to add αHOS to α1, only when α1 is made lean (the first upstream $O_2$ sensor 12 of the bank 1 indicates rich at step 101).

Figure 12:
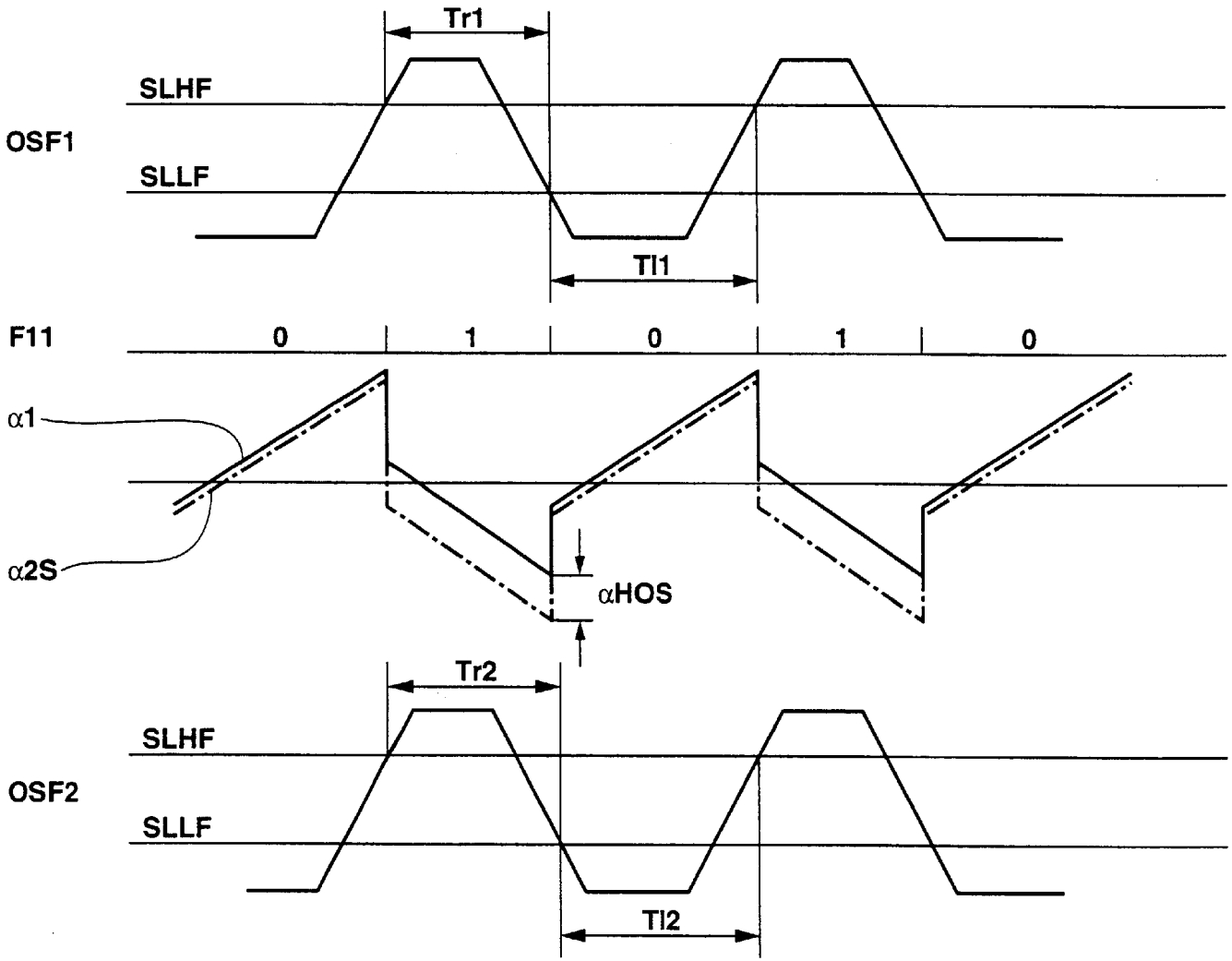
FIG. 12 is a modeled waveform of the output of the $O_2$ sensor on the upstream side of the catalytic converter after the phase synchronization control is completed, according to the second preferred embodiment of the present invention.

FIG. 12 (corresponding to FIG. 10) shows operations of the second preferred embodiment of the present invention under the same conditions as those of the first embodiment. The correction quantity αHOS of the second preferred embodiment substantially doubles the correction quantity αHOS of the first preferred embodiment. In the second preferred embodiment it is when the correction quantity αHOS of the second preferred embodiment becomes equal to the double of the correction quantity αHOS of the first preferred embodiment that the second rich/lean ratio RBYL2 becomes equal to the target rich/lean ratio tRBYL2 of the bank 2 and the control settles down.

Figure 13:
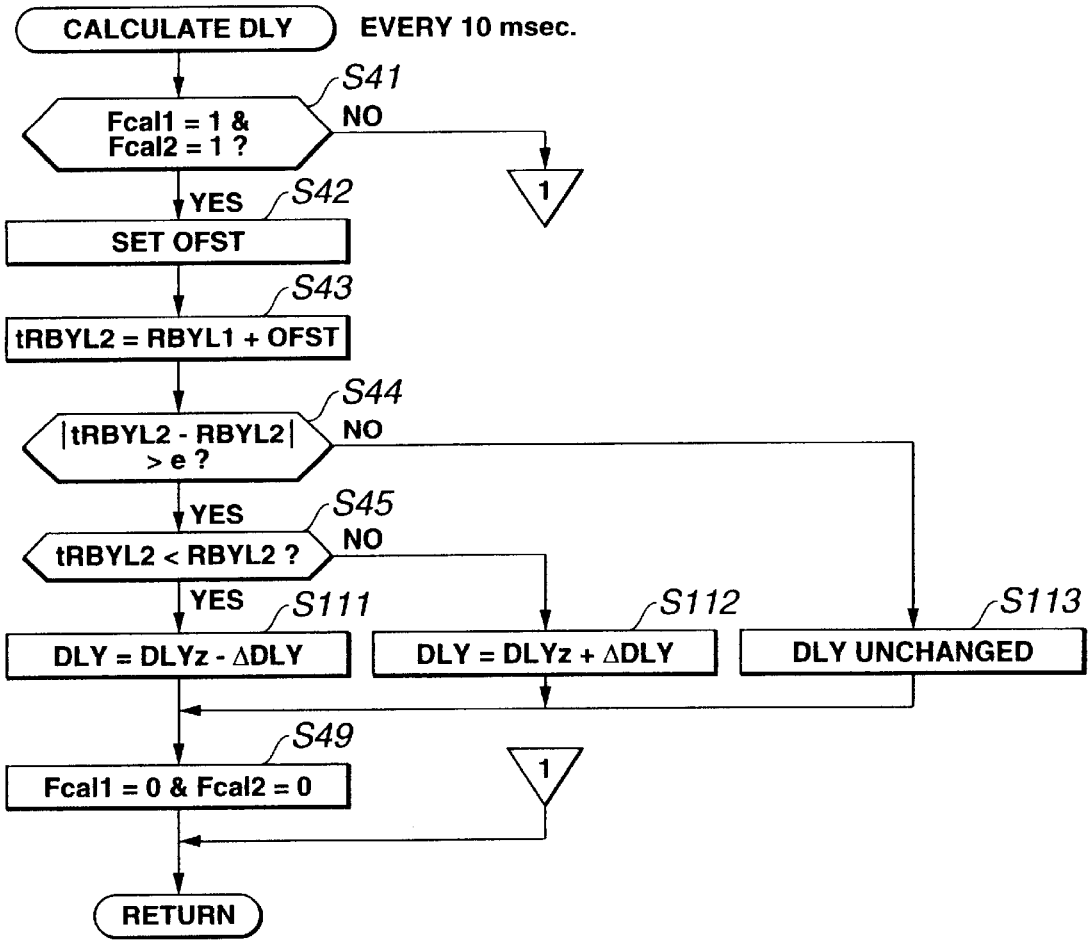
FIG. 13 is a flowchart for calculating a delay time DLY, according to a third preferred embodiment of the present invention.
Figure 14:
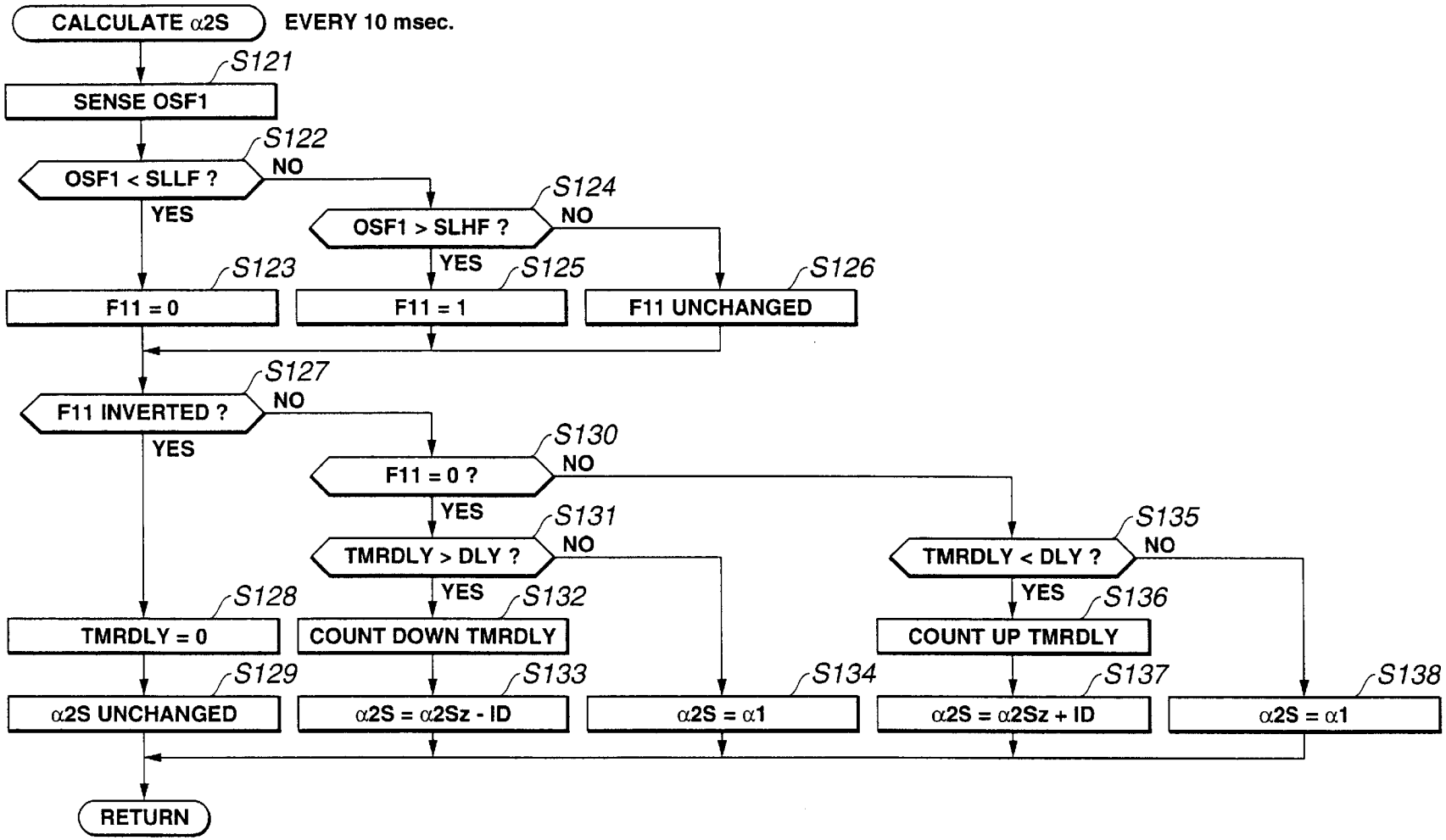
FIG. 14 is a flowchart for calculating the modified air-fuel ratio feedback correction coefficient α2S of the bank 2 when the phase synchronization request is present, according to the third preferred embodiment of the present invention.

FIG. 13 and FIG. 14 show flowcharts of a third preferred embodiment of the present invention. FIG. 13 and FIG. 14 respectively correspond to FIG. 4 and FIG. 7 of the first preferred embodiment.

Figure 15:
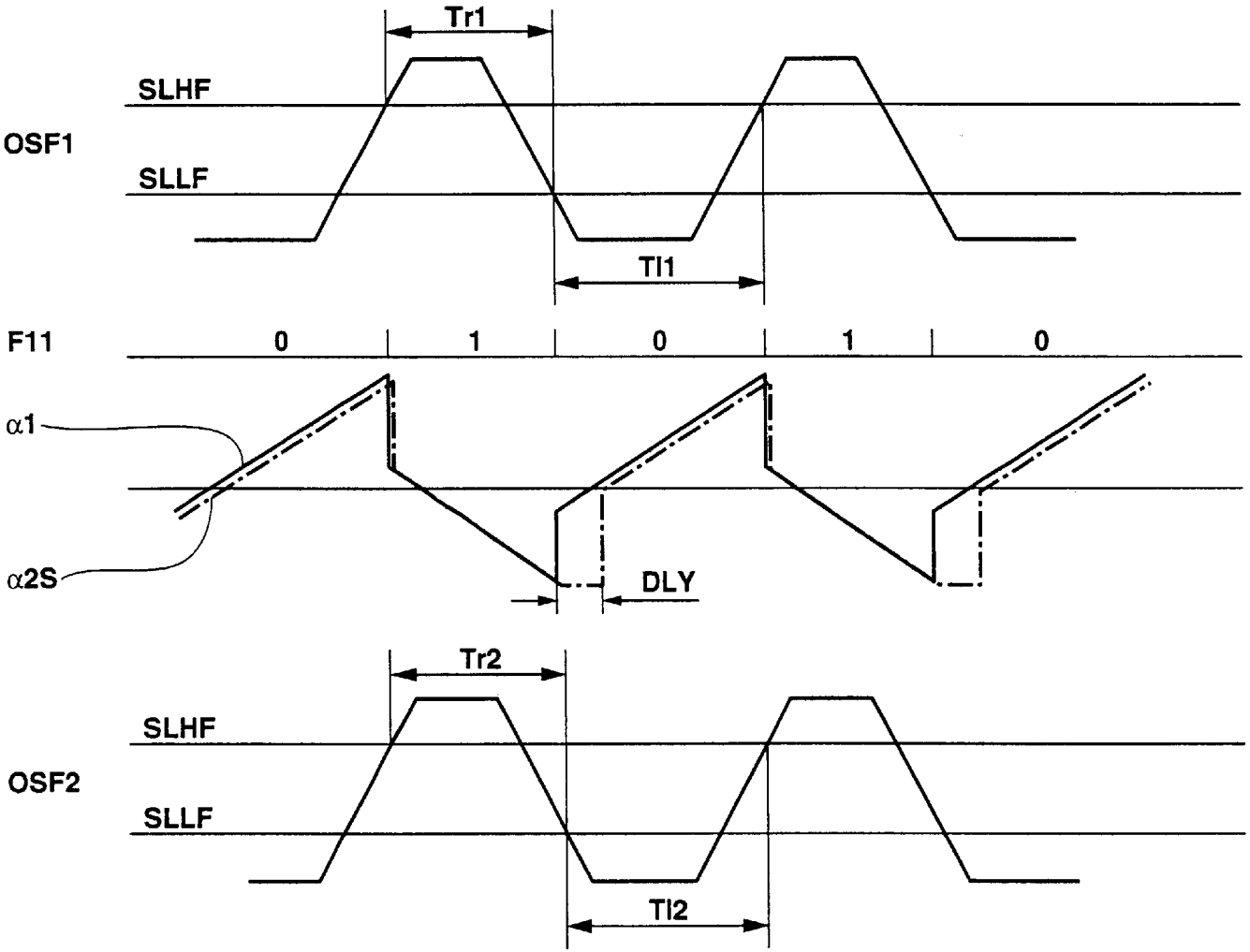
FIG. 15 is a modeled waveform of the output of the $O_2$ sensor on the upstream side of the catalytic converter after the phase synchronization control is completed, according to the third preferred embodiment of the present invention.

In the first preferred embodiment, as is seen in FIG. 10, the first air-fuel ratio feedback coefficient α1 of the bank 1 is, when the phase synchronization request is present, shifted upwardly or downwardly by an amount equaling the correction quantity αHOS, to thereby change the second rich/lean ratio RBYL2 of the bank 2. In the third preferred embodiment, as is seen in FIG. 15, when α1 is to be inverted, inversion of the α2S is delayed by an mount equaling a delay time (or correction quantity) DLY to thereby vary the second rich/lean ratio RBYL2 of the bank 2. In the third preferred embodiment, the controller determines, when the phase synchronization request is present, the modified air-fuel ratio feedback correction coefficient α2S of the bank 2 in accordance with the first air-fuel ratio feedback correction coefficient α1 of the bank 1 so that α2S follows α1, with a delay equaling the delay time DLY with respect to an inversion of α1.

FIG. 13 is substantially the same as FIG. 4. The delay time DLY is used in FIG. 13 (see steps 111, 112 and 113) in place of the correction quantity αHOS in FIG. 4. The steps other than the steps 111, 112 and 113 are the same as those in FIG. 4, and specific descriptions in FIG. 13 are skipped.

The thus calculated delay time DLY is stored in the memory in the ECM 11. In FIG. 14, the routine reads out the delay time DLY for calculating the modified air-fuel ratio feedback correction coefficient α2S of the bank 2 when the phase synchronization request is present.

Steps 121 to 127 and 130 in FIG. 14 are similar to steps 51 to 58 and 62 in FIG. 5. Descriptions of those similar steps are skipped. When the flag F11 is inverted, the routine proceeds from a step 127 to a step 128 to reset a counter TMRDLY to 0, and then holds the previous value of the α2S unchanged at a step 129. The counter TMRDLY is used for measuring the delay time DLY.

When the flag F11 is not inverted (step 127) and F11=0 (lean) at step 130, the routine proceeds to step 131 to compare the counter TMRDLY with the delay time DLY. If the routine proceeds for the first time to step 131 after the flag F11 is inverted, the counter TMRDLY is 0 (see steps 127 and 128). In this case, DLY may be equal to or greater than 0 (DLY≧0), or smaller than 0 (DLY<0).

1) DLY≧0:

Since TMRDLY≧DLY, the routine proceeds from step 131 to step 134, and sets the modified air-fuel ratio feedback correction coefficient α2S of the bank 2 equal to the first air-fuel ratio feedback correction coefficient α1 of the bank 1 without any modification.

2) DLY<0:

While TMRDLY>DLY, the routine proceeds from step 131 to step 132, and counts down the counter TMRDLY. Then, the routine proceeds to step 133 and calculates a current value of α2S by subtraction, from a previous value α2S z of the α2S, of an integral quantity (constant) ID. Repetition of step 132 makes the counter TMRDLY negatively larger. When TMRDLY becomes equal to or smaller than DLY (TMRDLY≧DLY), the routine proceeds from step 131 to step 134, sets the modified air-fuel ratio feedback correction coefficient α2S of the bank 2 equal to the first air-fuel ratio feed back correction coefficient α1.

When the flag F11 is not inverted (step 127) and F11=1 (rich) (step 130), the routine proceeds to step 135, and compares the counter TMRDLY with the delay time DLY. In this case, DLY may be equal to or greater than 0 (DLY≧0), or may be smaller than 0 (DLY<0).

3) DLY≧0:

While TMRDLY<DLY, the routine proceeds from step 135 to step 136, and counts up the counter TMRDLY. Then, the routine proceeds to step 137 and calculates a current value of α2S by adding the integral quantity (constant) ID to the α2Sz which is a previous value of the α2S . Repeating step 136 makes the counter TMRDLY positively larger. When TMRDLY≧DLY, the routine proceeds from step 135 to step 138, and sets the modified air-fuel ratio feedback correction coefficient α2S of the bank 2 equal to the first correction coefficient α1.

4) DLY<0:

The answer of step 135 is negative because TMRDLY≧DLY. The routine proceeds to step 138, and sets the modified air-fuel ratio feedback correction coefficient α2S of the bank 2 equal to α1.

The integral quantity ID is used for gradually increasing or decreasing α2S during the delay. If the integral quantity ID is positive, α2S during the delay time varies in the opposite direction to α1. In this case, the delay time DLY becomes comparatively short when the control settles down (the second rich-lean ratio RBYL2 of the bank 2 is equal to the target rich/lean ratio tRBYL2 of the bank 2). If the integral quantity ID=0, α2S remains equal to a previous value during the delay time, so that the range in which α2S varies becomes equal to the range of α1. However, in this case the delay time DLY becomes comparatively long when the control settles down.

As evident from 1) and 2) above, the delay operation of step 133 is carried out only when the delay time DLY is negative. In the case of 3) and 4) above, the delay operation of step 137 is carried out only when the delay time DLY is equal to or greater than 0.

The rich lean ratio RBYL2 achieved by the thus-calculated modified coefficient α2S is larger (on the rich side) than the rich lean ratio achieved by (α1 when the delay time DLY is equal to or greater than 0, and smaller when the delay time DLY is negative.

FIG. 15 (corresponding to FIG. 10) shows operations of the third preferred embodiment of the present invention (In this example, the integral quantity ID=0) under the same conditions as those of the first preferred embodiment. In the third preferred embodiment, the inversion of α2S is delayed compared with α1 by an amount equaling the correction quantity (delay time) DLY in the case of inversion of flag F11 from "1" to "0", to thereby increase the second rich/lean ratio RBYL2 of the bank 2 when the phase synchronization request is present. With this, the third preferred embodiment brings about the same operational effect as that of the first preferred embodiment.

In the aforementioned embodiments of the present invention, the second rich/lean ratio RBYL2 of the bank 2 is fundamentally made equal to the first rich/lean ratio RBYL1 of the bank 1, and minor differences in characteristics between the bank 1 and the bank 2 are compensated for by the offset quantity OFST since the first rich/lean ratio RBYL1 of the bank 1 is accurately feedback-controlled at the stoichiometric air-fuel ratio, and the first rich/lean ratio RBYL1 and the second rich/lean ratio RBYL2 are almost the same if the bank 1 and the bank 2 are controlled at the same air-fuel ratio. Especially, when the engine operation is somewhat varying, it is effective to adjust the rich/lean ratio of the bank 2 to the accurately controlled rich/lean ratio-of the bank 1.

Although not described in the embodiments, the correction quantity αHOS or DLY may be calculated in the following manner. The rich/lean ratio is determined, as a target ratio, by learning when, in the absence of the phase synchronization request, the second cylinder group is feedback-controlled independently. Then, the correction quantity αHOS or DLY is calculated so as to bring the actual rich/lean ratio of the second cylinder group in the presence of the phase synchronization request, closer to the stored (learned) (target) rich/lean ratio of the bank 2. This calculation method is effective in obtaining a satisfactory air-fuel ratio accuracy, especially during steady state operations free of variations of operating conditions.

FIG. 16 shows, as an example, an arrangement of various sections of a control system which can be employed in the illustrated embodiment.

An air-fuel ratio control system shown in FIG. 16 includes a first cylinder group 21, a second cylinder group 22, a first catalytic converter 23 disposed in a first exhaust passage from the first cylinder group, a second catalytic converter 24 disposed in a second exhaust passage from the second cylinder group, a sensing device 25 sensing an air-fuel ratio of an exhaust gas mixture flowing into the first catalytic converter, and a sensing device 26 sensing an air-fuel ratio of an exhaust gas mixture flowing into the second catalytic converter. The control system further includes a section 27 for calculating a first air-fuel ratio feedback correction coefficient in 30) accordance with an output of the device 25, a section 28 for feedback-controlling an air-fuel ratio of the first cylinder group by using the first air-fuel ratio feedback correction coefficient, a section 30 for determining whether a predetermined phase synchronization request is present for synchronizing air-fuel ratio variation of the first and second cylinder groups, a section 31 for measuring a rich time and a lean time in the air-fuel ratio variation of the second cylinder group to deter-mine a second cylinder group's rich/lean ratio between the rich time and the lean time when the synchronization request is present, a section 32 for calculating a correction quantity to bring the second cylinder group's ratio closer to a target ratio when the synchronization request is present, a section 33 for determining a modified coefficient by modifying the first air-fuel ratio feedback correction coefficient with the correction quantity, and a section 34 for feedback-controlling the air-fuel ratio of the second cylinder group by using the modified coefficient as a second air-fuel ratio feedback correction coefficient when the phase synchronization request is present. There are further provided a section 29 for calculating an unmodified coefficient to be used as the second air-fuel ratio feedback correction coefficient in accordance with an output of the second air-fuel ratio sensor, and the second 34 feedback-controls the air-fuel ratio of the second cylinder group by using the modified coefficient when the synchronization request is present, and by using the unmodified coefficient as-the second feedback correction coefficient when the synchronization request is absent.

The entire contents of Japanese Patent Application P11 (1999)-157598 (filed Jun. 4, 1999 in Japan) is incorporated herein by reference.

Although the invention has been described above by reference to certain embodiments of the invention, the invention is not limited to the embodiments described above. Modifications and variations of the embodiments described above will occur to those skilled in the art, in light of the above teachings.

The scope of the invention is defined with reference to the following claims.

What is claimed is:

1. An air-fuel ratio control system for an engine, the air-fuel ratio control system comprising:

a first cylinder group;

a second cylinder group;

a first catalytic converter disposed in a first exhaust passage from the first cylinder group;

a second catalytic converter disposed in a second exhaust passage from the second cylinder group;

a first air-fuel ratio sensor sensing an air-fuel ratio of an exhaust gas mixture flowing into the first catalytic converter;

a second air-fuel ratio sensor sensing an air-fuel ratio of an exhaust gas mixture flowing into the second catalytic converter; and a controller calculating a first air-fuel ratio feedback correction coefficient in accordance with an output of the first air-fuel ratio sensor, feedback-controlling an air-fuel ratio of the first cylinder group by using the first air-fuel ratio feedback correction coefficient, determining whether a predetermined phase synchronization request is present for synchronizing air-fuel ratio variation of the first and second cylinder groups, measuring a rich time and a lean time in the air-fuel ratio variation of the second cylinder group in accordance with an output of the second air-fuel ratio sensor to determine a second cylinder group's ratio between the rich time and the lean time, calculating a correction quantity to bring the second cylinder group's ratio closer to a target ratio when the synchronization request is present, determining a modified coefficient by modifying the first air-fuel ratio feedback correction coefficient with the correction quantity, and feedback-controlling the air-fuel ratio of the second cylinder group by using the modified coefficient as a second air-fuel ratio feedback correction coefficient when the phase synchronization request is present.

2. The air-fuel ratio control system as claimed in claim 1, wherein the controller further calculates an unmodified coefficient to be used as the second air-fuel ratio feedback correction coefficient in accordance with an output of the second air-fuel ratio sensor, and feedback-controls the air-fuel ratio of the second cylinder group by using the modified coefficient as the second feedback correction coefficient when the synchronization request is present, and by using the unmodified coefficient as the second feedback correction coefficient when the synchronization request is absent.

3. The air-fuel ratio control system as claimed in claim 2, wherein the controller measures a rich time and a lean time in air-fuel ratio variation of the first cylinder group in accordance with the output of the first air-fuel ratio sensor, to determine a first cylinder group's ratio of the air-fuel ratio variation of the first cylinder group between the rich time and lean time of the first cylinder group, and determines the target ratio for the second cylinder group in accordance with the first cylinder group's ratio.

4. The air-fuel ratio control system as claimed in claim 3, wherein the controller sets the target ratio for the second cylinder group equal to the first cylinder group's ratio between the rich time and lean time of the air-fuel ratio variation of the first cylinder group.

5. The air-fuel ratio control system as claimed in claim 3, wherein the controller determines the target ratio for the second cylinder group by algebraic addition of an offset quantity to the first cylinder group's ratio between the rich time and lean time of the air-fuel ratio variation of the first cylinder group as the desired ratio.

6. The air-fuel ratio control system as claimed in claim 4, wherein the air-fuel ratio control system further comprises a sensor that senses an engine operating condition to determine an engine speed, and a sensor that senses an engine operating condition to determine an engine load, and the controller determines the offset quantity in accordance with the engine speed and the engine load.

7. The air-fuel ratio control system as claimed in claim 6, wherein the controller determines a difference between the first cylinder group's ratio between the rich time and the lean time and the second cylinder group's ratio between the rich time and the lean time while the phase synchronization request is absent, stores values of the difference between the first cylinder group's ratio and the second cylinder group's ratio as a function of the engine speed and the engine load condition, and uses the values of the difference as the offset quantity when the phase synchronization request is present.

8. The air-fuel ratio control system as claimed in claim 1, wherein the controller changes the correction quantity so as to reduce a deviation of the second cylinder group's ratio from the target ratio.

9. The air-fuel ratio control system as claimed in claim 8, wherein the controller holds the correction quantity unchanged when an absolute value of the deviation of the second cylinder group's ratio from the target ratio is equal to or smaller than a predetermined value.

10. The air-fuel ratio control system as claimed in claim 1, wherein the controller produces the phase synchronization request when a diagnosis for at least one of the catalytic converters is to be performed.

11. The air-fuel ratio control system as claimed in claim 10, wherein the air-fuel ratio control system further comprises a third air-fuel ratio sensor sensing an air-fuel ratio of an exhaust gas mixture flowing in a common exhaust passage receiving the exhaust gas mixtures from the first and second exhaust passages, and the controller performs the diagnosis in accordance with an output of the third air-fuel ratio sensor.

12. The air-fuel ratio control system as claimed in claim 1, wherein the controller determines the modified coefficient by algebraic addition of the correction quantity to the first air-fuel ratio feedback coefficient for the first cylinder group.

13. The air-fuel ratio control system as claimed in claim 12, wherein the controller increases the modified coefficient by algebraically adding a positive value of the correction quantity to the first air-fuel ratio feedback correction coefficient only when the air-fuel ratio sensed by the first air-fuel ratio sensor is lean, and decreases the modified coefficient by algebraically adding a negative value of the correction quantity to the first air-fuel ratio feedback correction coefficient only when the air-fuel ratio sensed by the first air-fuel ratio sensor is rich.

14. The air-fuel ratio control system as claimed in claim 1, wherein the controller determines the modified coefficient in accordance with the first air-fuel ratio feedback correction coefficient so that the modified coefficient follows the first air-fuel ratio feedback correction coefficient with a delay time determined by the correction quantity.

15. The air-fuel ratio control system as claimed in claim 14, wherein the modified coefficient is determined so as to delay an inversion of the modified coefficient with respect to an inversion of the first air-fuel ratio feedback coefficient by an amount equaling the correction quantity, and the controller determines the correction quantity so as to reduce a deviation of the second cylinder group's ratio from the target ratio.

16. An air-fuel ratio control process for an engine having a first cylinder group, a second cylinder group, a first catalytic converter disposed in a first exhaust passage from the first cylinder group, and a second catalytic converter disposed in a second exhaust passage from the second cylinder group, the air-fuel ratio control process comprising:

ascertaining a sensed first air-fuel ratio of an exhaust gas mixture flowing into the first catalytic converter, ascertaining a sensed second air-fuel ratio of an exhaust gas mixture flowing into the second catalytic converter, calculating a first air-fuel ratio feedback correction coefficient in accordance with the sensed first air-fuel ratio, to feedback-control an actual air-fuel ratio of the first cylinder group by using the first air-fuel ratio feedback correction coefficient;

determining whether a predetermined phase synchronization request is present for synchronizing air-fuel ratio variation of the first and second cylinder groups;

measuring a rich time and a lean time in the air-fuel ratio variation of the second cylinder group in accordance with the sensed second air-fuel ratio to determine a second cylinder group's ratio between the rich time and the lean time;

calculating a correction quantity to bring the second cylinder group's ratio closer to a target ratio when the synchronization request is present; and determining a modified coefficient by modifying the first air-fuel ratio feedback correction coefficient with the correction quantity, to feedback-control the air-fuel ratio of the second cylinder group by using the modified coefficient as a second air-fuel ratio feedback correction coefficient when the synchronization request is present.

17. The air-fuel ratio control process as claimed in claim 16, wherein the air-fuel ratio control process further comprises calculating an unmodified coefficient in accordance with the sensed second air-fuel ratio, feedback-controlling the actual air-fuel ratio of the first cylinder group by using the first air-fuel ratio feedback correction coefficient, and feedback-controlling the actual air-fuel ratio of the second cylinder group by using the modified coefficient as the second air-fuel ratio feedback correction coefficient when the synchronization request is present and by using the unmodified coefficient as the second air-fuel ratio feedback correction coefficient when the synchronization request is absent; and wherein the air-fuel ratio control process further comprises determining a first cylinder group's ratio of the air-fuel ratio variation of the first cylinder group between the rich time and lean time by measuring a rich time and a lean time in air-fuel ratio variation of the first cylinder group in accordance with the sensed first air-fuel ratio, and determining the target ratio for the second cylinder group in accordance with the first cylinder group's ratio.

18. The air-fuel ratio control process as claimed in claim 17, wherein the target ratio for the second cylinder group is set equal to the first cylinder group's ratio between the rich time and lean time of the air-fuel ratio variation of the first cylinder group.

19. The air-fuel ratio control process as claimed in claim 17, wherein the target ratio for the second cylinder group is determined by algebraic addition of a nonzero offset quantity to the first cylinder group's ratio between the rich time and lean time of the air-fuel ratio variation of the first cylinder group.

20. An air-fuel ratio control apparatus for an engine having a first cylinder group, a second cylinder group, a first catalytic converter disposed in a first exhaust passage from the first cylinder group, a second catalytic converter disposed in a second exhaust passage from the second cylinder group, a first air-fuel ratio sensor sensing an air-fuel ratio of an exhaust gas mixture flowing into the first catalytic converter, and a second air-fuel ratio sensor sensing an air-fuel ratio of an exhaust gas mixture flowing into the second catalytic converter, the air-fuel ratio control apparatus comprising:

means for calculating a first air-fuel ratio feedback correction coefficient in accordance with an output of the first air-fuel ratio sensor;

means for feedback-controlling an air-fuel ratio of the first cylinder group by using the first air-fuel ratio feedback correction coefficient;

means for determining whether a predetermined phase synchronization request is present for synchronizing air-fuel ratio variation of the first and second cylinder groups;

means for measuring a rich time and a lean time in the air-fuel ratio variation of the second cylinder group in accordance with an output of the second air-fuel ratio sensor to determine a second cylinder group's ratio between the rich time and the lean time;

means for calculating a correction quantity to bring the second cylinder group's ratio closer to a target ratio when the synchronization request is present;

means for determining a modified coefficient by modifying the first air-fuel ratio feedback correction coefficient with the correction quantity; and means for feedback-controlling the air-fuel ratio of the second cylinder group by using the modified coefficient as a second air-fuel ratio feedback correction coefficient when the synchronization request is present.

* * * * *